US006513917B1

(12) United States Patent
Matsuda et al.

(10) Patent No.: US 6,513,917 B1
(45) Date of Patent: Feb. 4, 2003

(54) LIQUID EJECTION DEVICE AND METHOD OF PRODUCING THE SAME

(75) Inventors: Riki Matsuda, Nagoya (JP); Shigeru Suzuki, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 09/349,695

(22) Filed: Jul. 8, 1999

(30) Foreign Application Priority Data

Jul. 8, 1998 (JP) ..... 10-192950
Jul. 8, 1998 (JP) ..... 10-192951
Jul. 8, 1998 (JP) ..... 10-192952
Jul. 8, 1998 (JP) ..... 10-192953

(51) Int. Cl.[7] ..... B41J 2/045
(52) U.S. Cl. ..... 347/70
(58) Field of Search ..... 347/68, 72

(56) References Cited

U.S. PATENT DOCUMENTS 5,767,612 A * 6/1998 Takeuchi et al. ..... 310/324
5,975,668 A * 11/1999 Fujii et al. ..... 347/10
6,176,570 B1 * 1/2001 Kishima et al. ..... 347/70

* cited by examiner

*Primary Examiner*—Thinh Nguyen
(74) *Attorney, Agent, or Firm*—Pitney, Hardin, Kipp & Szuch LLP

(57) ABSTRACT

A silicon single crystal substrate is formed with a plurality of channels that are partitioned by a plurality of partition walls and that are arranged at a pitch of 40 $\mu$m or less, for example. A filler material is then introduced into the channels to a height that matches the upper edges of the partition walls. After the filler material is hardened by heating a cover film is deposited to a thickness of 5 $\mu$m or less on the upper surface of the filler material and on the upper edges of the partition walls. As a result, the cover film has the same, flat shape as the upper surface of the filler material and the upper edges of the partition walls. Next, the filler material is removed so that the cover film remains covering the channels. Next, electrodes are formed on the cover film. A drive voltage is applied to a desired electrode to deform the cover film at a corresponding area, whereupon pressure is applied to liquid in the corresponding channel, and liquid is ejected from an aperture that is provided at the front end of the subject channel. Thus, the compact and high density liquid ejection device with a large deformation amount and with good drive efficiency can be easily manufactured.

37 Claims, 17 Drawing Sheets

LIQUID EJECTION DEVICE AND METHOD OF PRODUCING THE SAME

BACKGROUND OF THE INVENTION

1. Field of the Invention

The present invention relates to a liquid ejection device, such as an ink jet head, and a method of producing the liquid ejection device.

2. Description of the Related Art

The liquid ejection device is provided with a plurality of channels filled with liquid. The liquid ejection device is driven to apply pressure to liquid filling a selected channel, thereby allowing liquid to be ejected from the selected channel at its ejection opening or nozzle.

An ink jet head is a representative example of the liquid ejection device. There is a great demand for high-precision and compact liquid ejection devices with nozzles aligned in a high density to enable printing at a high resolution. There is also a need for a production method that enables producing such liquid ejection devices, at excellent yields, by using simple micromachining processes.

SUMMARY OF THE INVENTION

It is an objective of the present invention to provide a compact liquid ejection device and a method for producing the compact liquid ejection device in excellent yields.

In order to attain the above and other objects, the present invention provides a liquid ejection device, comprising: a substrate formed with a plurality of partition walls for defining a plurality of channels. each partition wall having an upper edge, each channel having a groove shape with an inner surface including a bottom surface, each two adjacent channels being separated from each other by a corresponding partition wall, each channel having, at at least one end thereof, a liquid ejection aperture for ejecting liquid filling the channel; a cover film, having a thickness of 5 $\mu$m or less, that is provided over the upper edge of at least one of the plurality of partition walls, the cover film covering at least one of the plurality of channels: and a pressure applying structure that selectively deforms the cover film to apply pressure to liquid filling a desired channel, thereby ejecting liquid from the desired channel through its ejection aperture.

Preferably, the liquid ejection device may be produced using a thin film formation or deposition technique to deposit, on the top of a substrate formed with a plurality of channels, a cover film that will serve to apply pressure to liquid in the channels.

According to another aspect, therefore, the present invention provides a liquid ejection device, comprising: a substrate formed with a plurality of partition walls for defining a plurality of channels, each partition wall having an upper edge, each channel having a groove shape with a bottom surface, each two adjacent channels being separated from each other by a corresponding partition wall, each channel having, at at least one end thereof, a liquid ejection aperture for ejecting liquid filling the channel; a cover film, deposited over the upper edge of at least one of the plurality of partition walls, covering at least one of the plurality of channels; and a pressure applying structure that selectively deforms the cover film to apply pressure to liquid filling a desired channel, thereby ejecting liquid from the desired channel through its ejection aperture.

The substrate may preferably be processed to be formed with the plurality of partition walls defining the plurality of channels. each partition wall having the upper edge, each channel having a groove shape with the bottom surface, each two adjacent channels being separated from each other by the corresponding partition wall, each channel having, at at least one end thereof, the liquid ejection aperture for ejecting liquid filling the channel. The cover film may preferably be deposited over the upper edge of the at least one of the plurality of partition walls to cover the at least one of the plurality of channels. The pressure applying structure may preferably be provided to selectively deform the cover film to apply pressure to liquid filling a desired channel, thereby ejecting liquid from the desired channel through its ejection aperture.

The cover film may preferably be deposited through introducing filler material into the plurality of channels up to the upper edges of the partition walls, depositing the cover film on the upper surface of the filler material and the upper edges of the plurality of partition walls, and removing the filler material from the channels after the cover film is deposited.

According to still another aspect, the present invention provides a method of producing a liquid ejection device, the method comprising the steps of: processing a substrate to be formed with a plurality of partition walls defining a plurality of channels, each partition wall having an upper edge, each channel having a groove shape with a bottom surface, each two adjacent channels being separated from each other by a corresponding partition wall. each channel having, at at least one end thereof, a liquid ejection aperture for ejecting liquid filling the channel; depositing a cover film over the upper edge of at least one of the plurality of partition walls to cover at least one of the plurality of channels; and providing a pressure applying structure that selectively deforms the cover film to apply pressure to liquid filling a desired channel, thereby ejecting liquid from the desired channel through its ejection aperture.

The cover film depositing step may preferably deposit the cover film over the upper edge of the at least one of the plurality of partition walls to a thickness of 5 $\mu$m or less. The cover film depositing step may preferably include the steps of: introducing filler material into the plurality of channels up to the upper edges of the partition walls; depositing the cover film on the upper surface of the filler material and the upper edges of the plurality of partition walls; and removing the filler material from the channels after the cover film is deposited.

BRIEF DESCRIPTION OF THE DRAWINGS

The above and other objects, features and advantages of the invention will become more apparent from reading the following description of the preferred embodiment taken in connection with the accompanying drawings in which:

FIG. 1(*b*) is a cross-sectional view of the liquid ejection device of the first embodiment taken along a line IB—IB in FIG. 1(*a*);

FIGS. 5(*c*) and 5(*d*) show perspective views illustrating a process for depositing a cover film on the flat upper surface of the silicon single crystal substrate whose channels are filled with filler material, wherein FIG. 5(*c*) is a perspective view showing the cover film deposited on the upper surface of the silicon single crystal substrate, and FIG. 5(*d*) is a perspective view illustrating the silicon single crystal substrate with the filler material being removed therefrom;

FIG. 7(*b*) is a cross-sectional view of the liquid ejection device of the second embodiment taken along a line VIIB—VIIB in FIG. 7(*a*);

FIG. 9(*b*) is a cross-sectional view taken along a line IXB—IXB of FIG. 9(*a*) showing the silicon single crystal substrate filled with the filler material;

FIGS. 9(*c*) and 9(*d*) show perspective views illustrating a process for depositing a cover film on the undulated upper surface of the silicon single crystal substrate whose channels are filled with filler material, wherein FIG. 9(*c*) is a perspective view showing the cover film deposited on the upper surface of the silicon single crystal substrate, and FIG. 9(*d*) is a perspective view illustrating the silicon single crystal substrate with the filler material being removed therefrom;

FIG. 11(*b*) is a cross-sectional view of the liquid ejection device of the third embodiment taken along a line XIB—XIB in FIG. 11(*a*);

FIGS. 13(*b*) and 13(*c*) illustrate a process for introducing a filler material into the channels of the silicon single crystal substrate, wherein FIG. 13(*b*) is a perspective view showing the silicon single crystal substrate with filler material filling the inside of the channels, and FIG. 13(*c*) is a cross-sectional view taken along a line XIIIC—XIIIC of FIG. 13(*b*) showing the silicon single crystal substrate filled with the filler material;

FIGS. 13(*d*) and 13(*e*) show perspective views illustrating a process for depositing a cover film on the undulated upper surface of the silicon single crystal substrate whose channels are filled with filler material, wherein FIG. 13(*d*) is a perspective view showing the cover film deposited on the upper surface of the silicon single crystal substrate, and FIG. 13(*e*) is a perspective view illustrating the silicon single crystal substrate with the filler material being removed therefrom.

DETAILED DESCRIPTION OF THE EMBODIMENTS

Figure 1A:
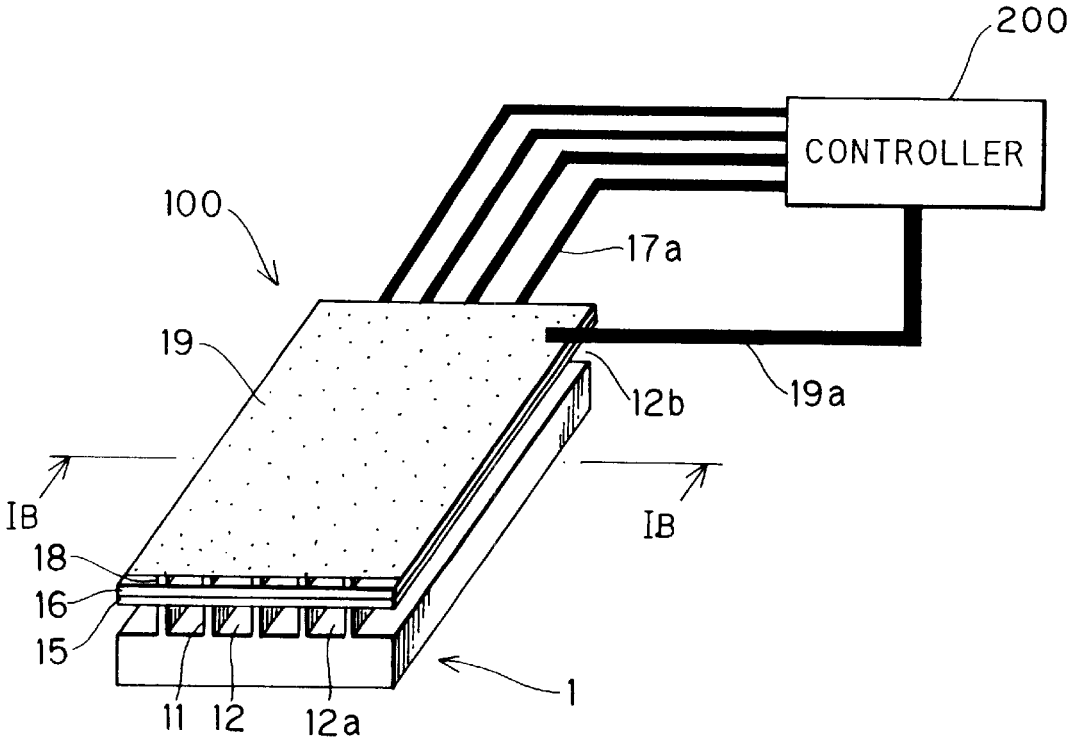
FIG. 1(*a*) is a perspective view showing a liquid ejection device according to a first embodiment of the present invention.

A liquid election device and a production method thereof according to embodiments of the present invention will be described while referring to the accompanying drawings wherein like parts and components are designated by the same reference numerals to avoid duplicating description.

[First Embodiment]

A liquid ejection device according to a first embodiment of the present invention will be described below with reference to FIGS. 1(*a*)–6(*c*).

Figure 1B:
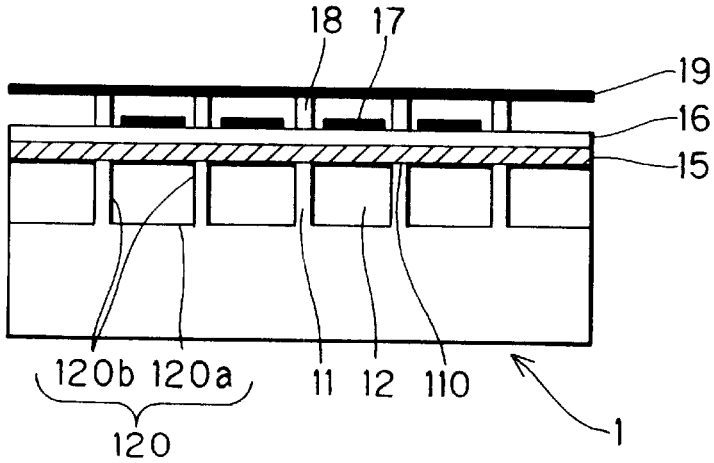

As shown in FIG. 1(*a*), the liquid ejection device 100 of the present embodiment has a substrate 1 made of silicon single crystal. A plurality of channels 12 are formed in groove shapes as partitioned by a plurality of partition walls 11. As shown in FIG. 1(*b*), each channel 12 has an inner surface 120 which includes a bottom surface 120*a* and a pair of side surfaces 120*b*. Each channel 12 has a liquid ejection aperture 12*a* at its front end for ejecting liquid filling the channel 12. Each channel 12 has a liquid supply aperture 12*b* at its rear end for supplying liquid into the corresponding channel 12 from a manifold (not shown).

A film-shaped cover 15 is provided over the upper edges 110 of the partition walls 11, thereby covering the channels 12. As shown In FIG. 1(*b*), the cover 15 has a flat shape in cross section. The cover 15 is made of silicon, for example, and serves as a vibration plate that can deform at a selective region to change the volume of a corresponding channel 12, thereby applying pressure to liquid filling the channel 12.

An insulation film 16 is provided over the cover 15. A plurality of individual electrodes 17 are provided over the top surface of the insulation film 16 at positions in one to one correspondence with the respective channels 12. A plurality of separate control wires 17*a* are provided in electrical connection with the respective individual electrodes 17.

A plurality of support walls 18 are provided over the top surface of the insulation film 16 at positions in one to one correspondence with the respective partition walls 11. A common electrode 19 is provided over the upper edges of the support walls 18 in confrontation with all the individual electrodes 17. A single control wire 19*a* is provided in electrical connection with the common electrode 19. The individual electrodes 17 and the common electrode 19 are applied with electric voltages to exhibit electrostatic force. thereby selectively deforming the cover film 15 to apply pressure to liquid filling a desired channel 12. This allows ejection of liquid from the desired channel 12 through its ejection aperture 12*a* and supply of liquid into the desired channel 12 through its supply aperture 12*b*.

The liquid ejection device 100 with the above-described structure is electrically connected to a control portion 200 via the control wires 17*a* and 19*a*. The control portion 200 applies electric voltages to the control wires 17*a* and 19*a*, thereby driving the liquid ejection device 100 to eject liquid selectively from desired channels 12.

According to this embodiment, the cover 15 is in a thin film shape and desirably has a thickness of 5 $\mu$m or less. Preferably, the cover 15 has a thickness within a range of 0.1 $\mu$m to 5 $\mu$m depending on desired vibration characteristic and liquid ejection amount. The thickness of the cover 15 is more preferably in a range of 0.1 $\mu$m to 2 $\mu$m to take into consideration the period of time required to form the thin film and the thin film properties. More specifically. if the cover film 15 is formed too thick, then too large of a drive voltage would be required to apply proper pressure to the liquid filling the channels 12. On the other hand, if the cover film 15 is formed too thinly, then the cover film 15 will be insufficiently elastic so that liquid can not be easily ejected from the channels 12. It is noted that the optimum thickness of the cover film 15 varies depending on the nature of the liquid to be ejected and on the shape of the channels 12.

With the above-described structure, the liquid ejection device 100 operates as described below.

Figure 2A:
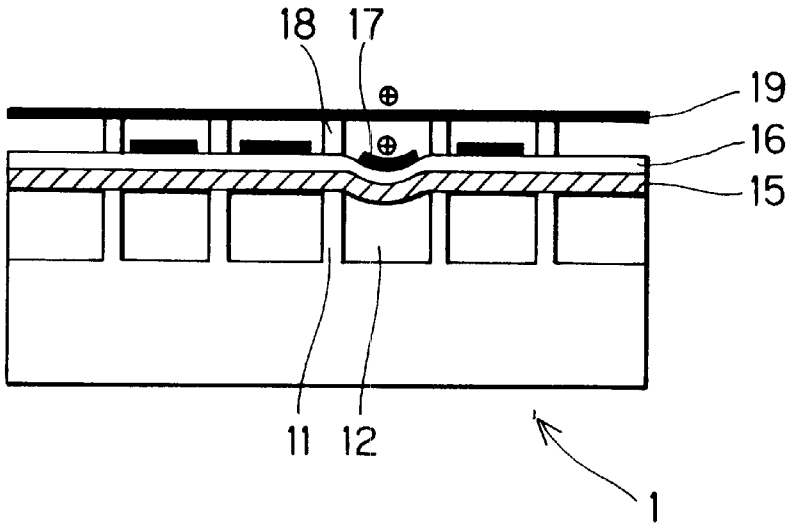
FIGS. 2(*a*) and 2(*b*) are cross-sectional views illustrating driving operations of the liquid ejection device of the first embodiment according to two types of driving manners, wherein FIG. 2(*a*) illustrates how a cover film is selectively deformed upon application of voltages of the same polarity to a common electrode and a selected individual electrode according to a first driving manner, and FIG. 2(*b*) illustrates how a cover film is selectively deformed upon application of voltages of the opposite polarities to the common electrode and the selected individual electrode according to a second driving manner.
Figure 2B:
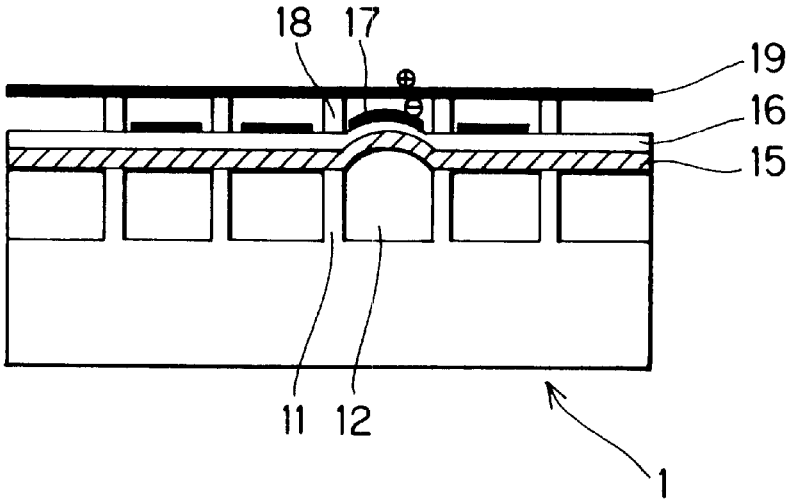

The liquid ejection device 100 can operate in two driving manners: a first driving manner shown in FIG. 2(*a*) and a second driving manner shown in FIG. 2(*b*). According to the first driving manner, voltages of the same polarity are applied to both the common electrode 19 and the individual electrodes 17. According to the second driving manner, on the other hand, voltages of the opposite polarities are applied to the common electrode 19 and the individual electrodes 17.

When the control portion 200 drives the liquid ejection device 100 in the first driving manner, as shown in FIG. 2(*a*), the control portion 200 applies a predetermined amount of voltage with the positive polarity to the common electrode 19 via the control wire 19*a*. A positive charge develops on the surface of the common electrode 19. In order to eject liquid from one desired channel 12, the control portion 200 applies another predetermined amount of voltage with the positive polarity to a corresponding individual electrode 17 that is disposed above the desired channel 12. The control portion 200 applies the voltage to the subject individual electrode 17 via the corresponding control wire 17*a*. As a result, a positive charge develops also on the surface of the individual electrode 17. The positive charges thus developed on the individual electrode 17 and the common electrode 19 repel each other due to electrostatic repulsion. The portion of the film 15, on which the energized individual electrode 17 is located, deforms into a concave shape protruding inward toward the subject channel 12. As a result, the volume of the subject channel 12 is reduced, and pressure is applied to the liquid filling the channel 12. A liquid droplet is ejected from the corresponding ejection aperture 12*a* as a result. When application of the voltage to the electrodes 17 and 19 is stopped, the cover film 15 restores its original shape (FIG. 1(*b*)), and the volume of the channel 12 increases, whereby liquid is introduced into the channel 12 through the supply opening 12*b*.

When the control portion 200 drives the liquid ejection device 100 in the second driving manner, as shown in FIG. 2(*b*), the control portion 200 applies the predetermined amount of voltage with the positive polarity to the common electrode 19. A positive charge therefore develops on the surface of the common electrode 19. In order to eject liquid from one desired channel 12, the control portion 200 applies another predetermined amount of voltage with a negative polarity to the corresponding individual electrode 17. As a result, a negative charge develops on the surface of the individual electrode 17. The negative charge developed on the individual electrode 17 and the positive charge developed on the common electrode 19 attract each other due to electrostatic force. As a result, the portion of the film 15, on which the energized individual electrode 17 is located, deforms into a convex shape protruding outwardly away from the channel 12. As a result, the volume of the channel 12 increases, and pressure in the channel 12 reduces. As a result, ink is drawn through the supply opening 12*b* into the channel 12. The control portion 200 then stops the application of the voltage to the individual electrode 17 and the common electrode 19, as a result of which the cover film 15 will return to its initial shape of before deformation. When the cover film 15 returns to its initial shape, the volume of the subject channel 12 reduces, pressure is applied to liquid in the channel 12, and a liquid droplet is ejected from the channel 12 through the ejection aperture 12*a*.

Next, an explanation will be provided for relationship between the thickness of the cover film 15 and drive conditions for ejecting liquid.

When the cover film 15 is deformed and driven by electrostatic force, a displacement amount of the cover film 15 can be represented by the following equation:

$$W = \frac{1}{2}\frac{Pa^4}{Eh^3}$$

wherein:

"W [m]" is the displacement amount of the cover film 15:

"P [N/m$^2$]" is pressure;

"h [m]" is the thickness of the cover film 15;

"a [m]" is a half of the width of each channel 12; and

"E" is Young's Modulus.

An amount of attraction pressure generated by electrostatic force is represented by the following equation:

$$p = \frac{\varepsilon}{2}\frac{V^2}{t^2}$$

wherein:

"p [N/m$^2$]" is the attraction pressure:

"ϵ[F/m]" is the permittivity;

"V [volts]" is a drive voltage that is defined as a difference between the amounts of the voltages applied to the common electrode 19 and the individual electrodes 17; and "t [m]" is the distance between the cover film 15 and the common electrode 19.

The amount that the volume changes in one channel 12 when the cover film 15 is deformed can be approximated using the following formula:

$$M = \frac{3}{4}abW$$

wherein:

"M [m$^3$]" is the amount of change in volume; and

"b [m]" is the length of the channels 12 in the lengthwise direction.

The volume change amount "M" corresponds to the amount of liquid ejected from the channel 12. Therefore, by using the above-described three formulas, the relationship between the amount of the drive voltage [volts] and the liquid ejection amount can be known.

For example, when h=1 μm, t=1 μm, $\epsilon=8.8\times10^{-12}$ (vacuum), and $E=11\times10^{10}$ (Young's Modulus of silicon), it can be determined that application of 50 [volts] will eject a 0.28 [pl ] droplet, application of 100 [volts] will eject a 1.10 [pl] droplet, application of 150 [volts] will eject a 2.50 [pl] droplet, and application of 200 [volts] will eject a 4.50 [p1] droplet. On the other hand, when the cover film 15 has an increased thickness of h=2 μm, for the same values of "t", "ϵ" and "E" as described above, application of 50 [volts] will eject a 0.03 [p1] droplet, application of 100 [volts] will eject a 0.13 [pl] droplet, application of 150 [volts] will eject a 0.31 [pl] droplet, application of 200 [volts] will eject a 0.55 [pl] droplet, and application of 500 [volts] will eject a 3.48 [p1] droplet. Thus, for the same drive voltage, the volume of the ejected droplets is reduced greatly when h=2 μm compared to the prior example when h=1 μm.

From this, it can be seen that it is beneficial to form the cover film 15 in a thin shape so that the cover film 15 can be driven with a low drive voltage. The thickness of the cover film 15 is preferably set to an appropriate value depending on the strength of the cover film 15 and the difficulty in forming the cover film 15. It is desirable to form the cover film 15 to a thickness of 5.0 μm or less. It is difficult to produce the cover film 5 to a thickness greater than 5 μm because of a stress generated in the cover film. It is preferable to form the cover film 15 to a thickness in the range of 0.1 μm to 5.0 μm. More preferably, the cover film 15 is formed to a thickness in the range of 0.1 μm to 2.0 μm. The cover film 15 whose thickness is in the range of 0.1 μm to 2.0 μm can be easily produced and can sufficiently operate in the desired conditions.

It is desirable that the electrodes 17 and 19 be applied with the drive voltage of 50 [volts] or less in order to reduce power consumption by the liquid ejection device 100 and to simplify the drive circuit 200 for driving the liquid ejection device 100. In this case also, as indicated by the above-described calculations, proper driving operation can be achieved by application of the drive voltage of 50 [volts] or less by selecting the driving conditions so as to maintain the thickness of the cover film 15 in the desirable range and still attain the required liquid ejection amount. It Is possible to select the driving conditions to allow the liquid ejection device 100 to be driven at an even smaller drive voltage. Accordingly, when selecting the driving conditions to allow the liquid ejection device 100 to be driven at drive voltages of 40 volts or less, for example, easily available parts that are used for general purposes can be used for producing the control portion 200. Especially when selecting the driving conditions to allow the liquid ejection device 100 to be driven at drive voltages of 5 volts or less, operation becomes possible with an operation voltage within a range normally used by integrated circuits. As a result, the circuit configuration of the control portion 200 can be simplified and costs for producing the overall system can be reduced. By thus driving the cover file 15 with a low drive voltage, electrical insulation is not a problem. Also, charge leaks can be prevented and cross-talk between adjacent channels 12 can be reduced.

Figure 3:
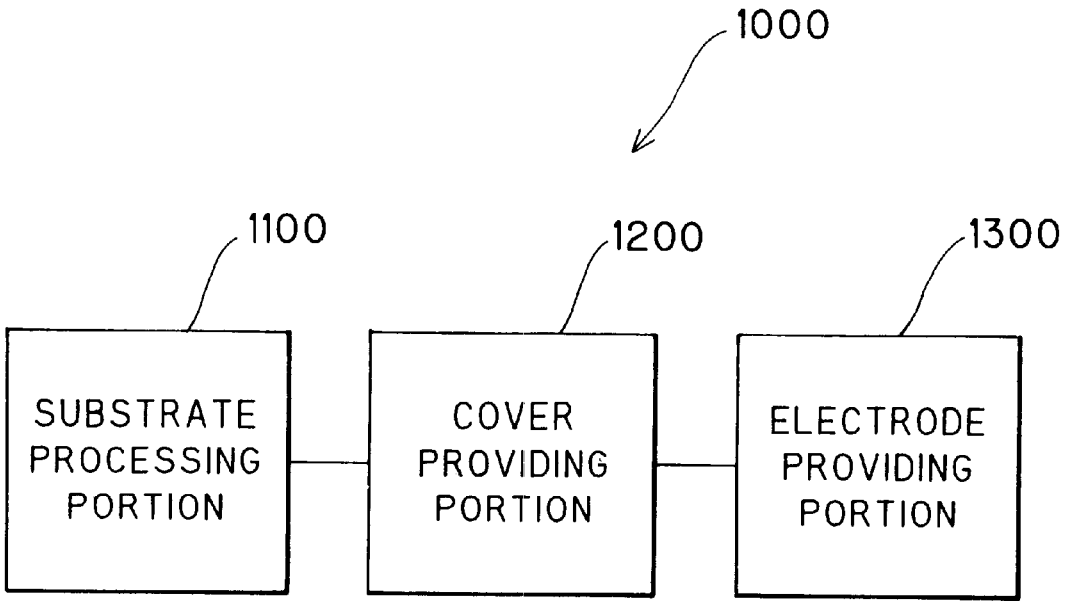
FIG. 3 is a block diagram showing an liquid ejection device producing apparatus according to the first embodiment of the present invention.

The liquid ejection device 100 with the above-described structure is produced by using a liquid ejection device production apparatus 1000 shown in FIG. 3.

According to the present embodiment, the liquid ejection device production apparatus 1000 produces the liquid ejection device 100 by processing the substrate 1 to be formed with the plurality of channels 12, and then depositing the cover film 15 onto the processed substrate 1.

More specifically, the liquid ejection device production apparatus 1000 includes: a substrate processing portion 1100, a cover providing portion 1200, and an electrode providing portion 1300. The substrate processing portion 1100 is for processing the silicon single crystal substrate 1 to form the plurality of channels 12 in the substrate 1 in groove shapes so that the plurality of channels 12 be partitioned by the plurality of partition walls 11 and so that each channel 12 have the aperture opening 12*a* and the supply opening 12*b* at its both ends.

The cover providing portion 1100 is for performing a deposition and structure fabrication process to first introduce filler material 13 (to be described later) into the channels 12 up to the upper edges of the partition walls 11, to deposit the cover film 15 on the upper surface of the filler material 13 and the upper edges of the plurality of partition walls 11, and then to remove the filler material 13.

The electrode providing portion 1300 is for performing an electrode providing process to deposit the insulation film 16 over the cover film 15, to form the individual electrodes 17 on the insulation film 16, to provide the plurality of support walls 18 on the insulation film 16, and to form the common electrode 19 over the support walls 18. The electrode providing portion 1300 also connects the individual electrodes 17 to the separate control wires 17*a* and connects the common electrode 19 to the single control wire 19*a*.

Next will be described how the liquid ejection device producing apparatus 1000 produces the liquid ejection device 100.

First, the substrate processing process performed by the substrate processing portion 1100 will be described below with reference to FIGS. 4(*a*) and 4(*b*).

During the substrate processing process, a silicon single crystal substrate 1 is prepared, and a plurality of groove-shaped channels 12 are formed on the silicon single crystal substrate 1. It is noted that the material of the substrate 1, in which the channels 12 are formed, can be a material other than the silicon single crystal. such as glass or a variety of different types of resins. However, the silicon single crystal substrate is easy to process with good yields.

Figure 4A:
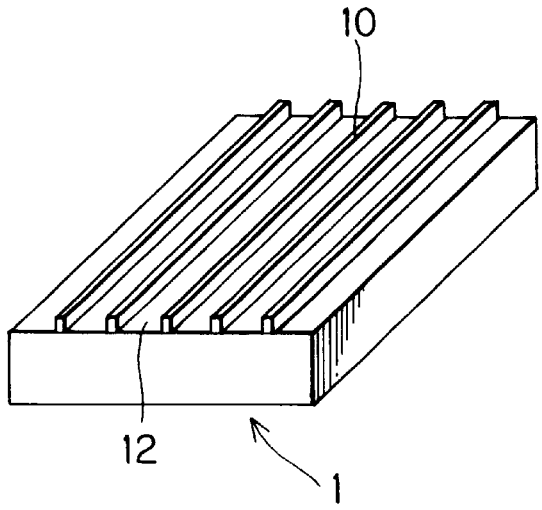
FIGS. 4(*a*) and 4(*b*) are perspective views illustrating a process for forming a plurality of groove-shaped channels in a silicon single crystal substrate, wherein FIG. 4(*a*) is a perspective view showing a patterning formed using photolithography on the silicon single crystal substrate, and FIG. 4(*b*) is a perspective view showing the condition of the silicon single crystal substrate formed with a plurality of groove-shaped channels through an etching process.
Figure 4B:
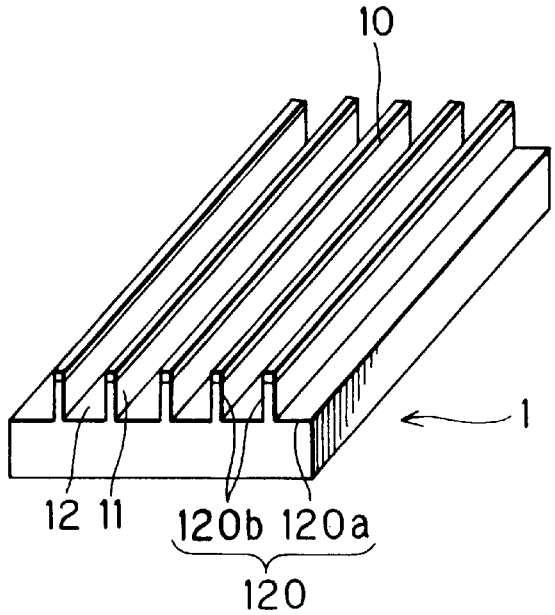
Figure 5A:
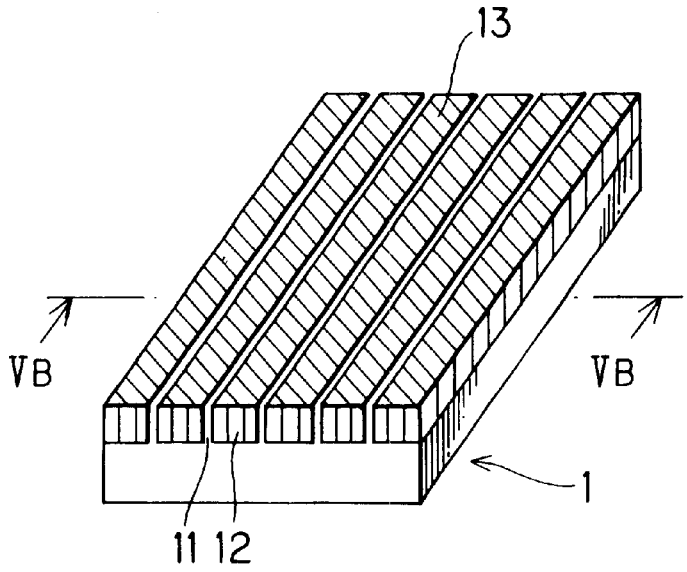
FIGS. 5(*a*) and 5(*b*) illustrate a process for introducing a filler material into the channels of the silicon single crystal substrate, wherein FIG. 5(*a*) is a perspective view showing the silicon single crystal substrate with filler material filling the inside of the channels and FIG. 5(*b*) is a cross-sectional view taken along a line VB—VB of FIG. 5(*a*) showing the silicon single crystal substrate filled with the filler material.
Figure 5B:
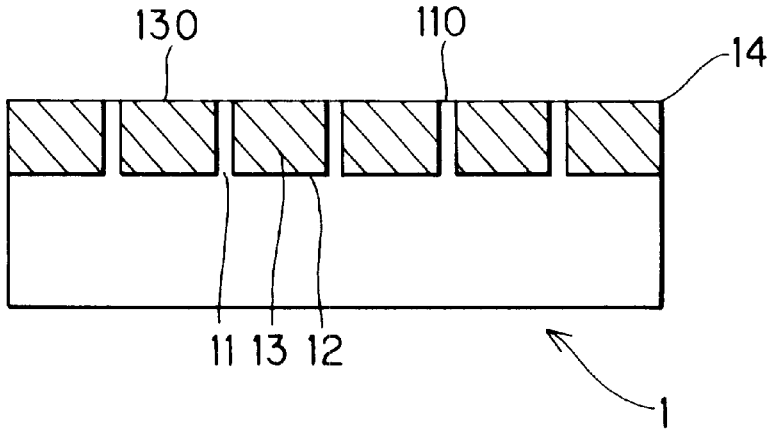
Figure 5C:
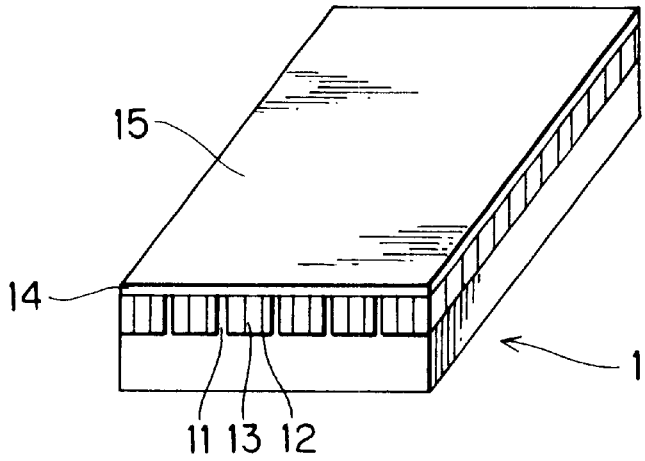
Figure 5D:
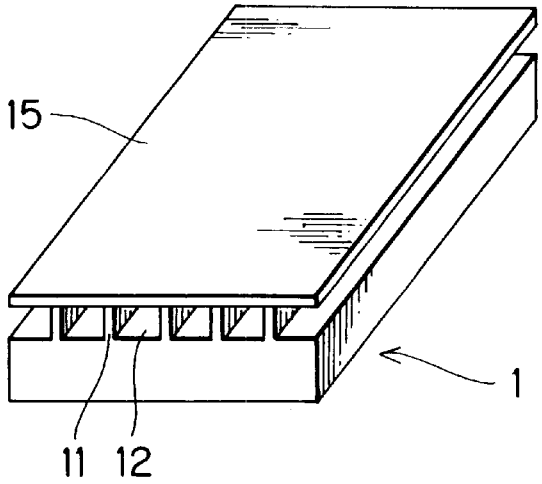

In order to form the channels 12, first, as shown in FIG. 4(*a*), a resist 10 is photographically patterned through a photolithography process on the substrate 1. As a result, the resist 10 is provided as a mask on the upper surface of the substrate 1 at positions where the partition walls 11 will be formed. The substrate 1 is not masked by the resist 10 at positions where the channels 12 will be formed.

It Is noted that the areas that are not masked by the resist 10 to form the channels 12 are arranged at a fixed pitch. In order to realize a high density channel distribution, it is desirable that the channels 12 be formed with a distribution pitch of 40 $\mu$m or less. For example, when the channel distribution pitch is set to 40 $\mu$m, about 600 channels 12 can be aligned per inch. The distribution pitch need only be set in accordance with a density amount required by the liquid ejection device 100 to be produced.

In this example, the resist 10 is provided to define each channel 12 to a width of 10 $\mu$m or less and a length of 2 mm or less. The resist 10 is deposited to a thickness that enables the resist 10 to be sufficiently thick to be maintained during an etching processes described below.

Then, the substrate 1 is etched to form the plurality of groove-shaped channels 12 therein. Etching can be performed using a wet etching technique with chemical products, or a dry etching technique with plasma and the like. Dry etching is superior for performing micromachining. When dry etching using plasma and the like is performed. anisotropic etching is possible. Therefore, the channels 12 can be easily produced with a configuration that is rectangular in cross section, having vertical side surfaces 120*b* and horizontal bottom surfaces 120*a*. Etching is performed until the channels 12 are etched to a depth approximately equal to the width of the channels 12. As a result, as shown in FIG. 4(*b*), the groove-shaped channels 12 are formed on the substrate 1 as having the bottom surfaces 120*a* and the side surfaces 120*b* and as being partitioned by the plurality of partition walls 11. Then, the resist 10 is removed.

The substrate 1 thus formed with the plurality of channels 12 is then subjected to the cover providing process by the cover providing portion 1200 (FIG. 3).

The cover providing process will be described below with reference to FIGS. 5(*a*)–5(*d*).

During the cover providing process, a filler material 13 is first introduced into all the channels 12 of the substrate 1 as shown in FIG. 5(*a*). It is noted that once hardened, the filler material 13, introduced into the channels 12, will serve as a base. on which the cover film 15 is deposited. Therefore, a resist that hardens at a predetermined setting temperature or more is used as the filler material 13.

It is noted that before introducing the filler material 13 Into the channels 12, it is desirable that the surfaces of the substrate 1 be treated to increase the hydrophobic nature of the entire surfaces 120 of the channels 12 and the entire upper edges 110 of the partition wall 11. The resist used as the filler material 13 has a low affinity to water. Accordingly, by increasing the hydrophobic nature of the surfaces 120 of the channels 12 and the upper edges 110 of the partition walls 11, the wettability with respect to the resist material 13 of the channels 12 and the partition walls 11 increases. When the filler material 13 is introduced into the channels 12, the filler material 13 can be uniformly distributed to the channels 12 so that the upper surface of the filler material 13 be flat as will be described later.

For example, an oxidation layer that is naturally formed on the surface of the silicon single crystal substrate 1 can be removed using hydrofluoric acid to increase the hydrophobic nature of the silicon single crystal substrate 1. More specifically, the oxidation layer that is naturally formed on the surface of the silicon normally has a high hydrophilic nature. Therefore, removing this oxidation layer can increase the hydrophobic nature of the silicon single crystal substrate 1. In this case, other special treatments for increasing the hydrophobic nature of the substrate 1 is unnecessary.

Then, liquid resist that serves as the filler material 13 is poured into the entire channels 12 until the upper surface of the filler material 13 reaches the upper edges of the partition walls 1. Then, the substrate 1 is heated to the predetermined set temperature or greater, as a result of which the filler material 13 hardens. Thus, as shown in FIG. 5(*a*), the channels 12 are completely filled with the filler material 13, whose upper surface 130 matches with the upper edges 110 of the partition walls 11. As a result. as shown in FIG. 5(*b*), an upper flat surface 14 of the processed substrate 1 is produced by the upper edges 110 of the partition walls 11 and the upper flat surface 130 of the filler material 13 that are arranged alternately.

In the above description, the flat surface 14 is obtained by simply adjusting the amount or height of the resist 13 introduced into the channels 12. However, a variety of other methods can be employed. For example, resist 13 of an amount slightly larger than the volume of the channels 12 can be introduced into the channels 12. After hardening the resist 13, the portion of the resist 13 that protrudes over the partition walls 11 can be removed through a spin coat technique or the like, using a polishing process, an exposure development process, an etching process, or other processes, Alternatively, resist of an amount slightly less than the volume of the channels 12 can be introduced into the channels 12, and then the upper edges of the partition walls 11 can be ground down using etching, polishing, or other techniques. Further, the difference in the etching rate of silicon 1 and the resist 13 can be used to level off the upper surface of the partition walls 11 and the hardened filler material 13.

Next, the cover film 15 is deposited entirely over the upper flat surface 14 of the substrate 1. More specifically, as shown in FIG. 5(*c*), the cover film 15 is deposited over the upper flat surface 14 through a physical deposition process. Representative examples of the physical deposition process include: vacuum deposition, sputtering, ion plating, and other various physical deposition processes. The cover film 15 could alternatively be formed through plating processes, chemical vapor deposition processes, LB (Langmuir-Blodgett) film formation processes. and the like.

The cover film 15 is formed from a material that is not corroded by liquid such as ink that is used to fill the channels 12. For example, the cover film 15 could be formed from silicon, that is relatively easy to handle, and that can be deposited through a sputtering technique or the like. Any other material that is not easily corroded by liquid such as ink and that can sufficiently function as a vibration plate can be used instead. It is noted that materials that are easily corroded by liquid such as ink could also be used as long as covered by some protective insulation material.

It is desirable that the cover film 15 be deposited to a thickness of 5 μm or less. As described already, this thickness range is desirable to ensure an appropriate vibration characteristic for the cover film 15 and to eject a sufficient amount of liquid from the channels 12.

After the cover film 15 is deposited over the upper flat surface 14 as shown in FIG. 5(*c*), the hardened filler material 13 is no longer necessary and therefore is removed. More specifically, the substrate 1 with the filler material 13 filling the channels 12 is immersed in a solvent, such as a resist removing liquid, for a duration of time predetermined as required to dissolve and remove the filler material 13. The solvent enters the channels 12 from the opening 12*a* and/or 12*b* and dissolves the filler material 13 in the channels 12. The filler material 13 dissolves approximately in twenty to thirty minutes.

During the above-described filler-removing process, the hardened filler material 13 is removed from the substrate 1 as shown in FIG. 5(*d*). Because the filler material 13 is now removed, all the channels 12 that are partitioned by the partition walls 11 are now covered from above by the cover film 15. The cover film 15 is in intimate sealing contact with the upper edges of the partition walls 11 and extends flatly entirely over the substrate 1.

The substrate 1 whose channels 12 are thus properly covered by the cover film 15 is then subjected to the electrode providing process achieved by the electrode providing portion 1300 (FIG. 3).

The electrode providing process will be described below with reference to FIGS. 6(*a*)–6(*c*).

First, the insulation film 16 is formed over the entire surface of the cover film 15. The insulation film 16 is deposited over the top surface of the cover film 15 using the same physical deposition process used for forming the cover film 15. It is noted that the thin film 16 is made from an inorganic material, and therefore chemical deposition process could be used instead.

Figure 6A:
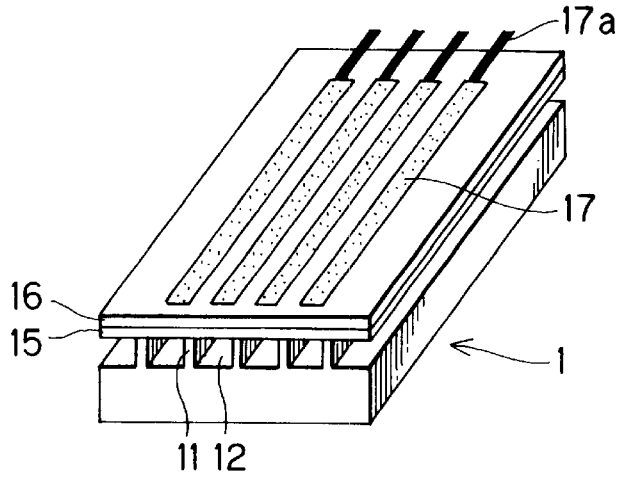
FIGS. 6(*a*), 6(*b*), and 6(*c*) are perspective views illustrating a process for forming electrodes on the upper surface of the cover film, wherein FIG. 6(*a*) is a perspective view showing a plurality of individual electrodes that are formed on the cover film via an insulation film so as to be located above and to extend following the plurality of channels, FIG. 6(*b*) is a perspective view showing a plurality of support walls attached to the top of the insulation film at positions between the individual electrodes, and FIG. 6(*c*) is a perspective view showing a common electrode formed on and supported by the plurality of support walls.
Figure 6B:
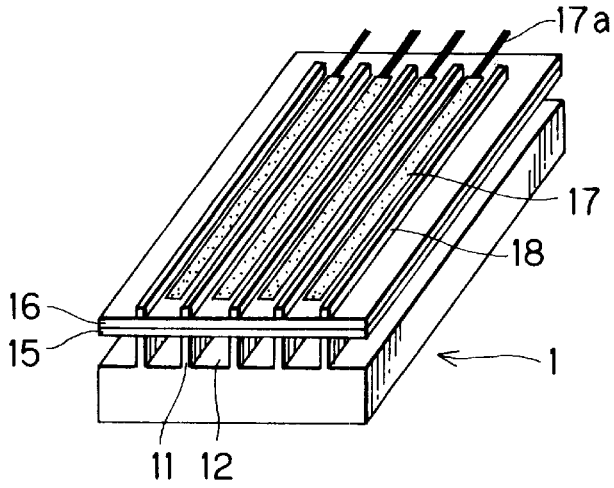
Figure 6C:
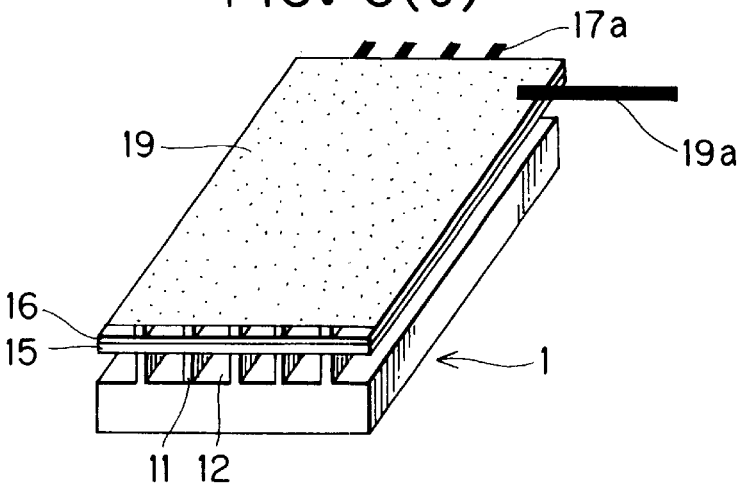

Then, the plurality of individual electrodes 17 are formed on the insulation film 16 at positions directly above the respective channels 12 as shown in FIG. 6(*a*). The individual electrodes 17 are electrically isolated from each other by the insulation film 16. Each individual electrode 17 is deposited on top of the insulation film 16 so as to extend following a corresponding channel 12. Separate control wires 17*a* are electrically connected to the respective individual electrodes 17 so that the individual electrodes 17 can be individually controlled to allow liquid to be ejected separately from each of the channels 12.

Then, as shown in FIG. 6(*b*), a plurality of support walls 18 are attached to the top surface of the insulation film 16 at positions between the individual electrodes 17. The plurality of partition walls 18 will serve to support the common electrode 19 thereon as shown in FIG. 6(*c*). As shown in FIG. 6(*b*), the support walls 18 are disposed at positions directly above the partition walls 11.

In order to form the support walls 18, material of the support walls 18 is first formed in a layer over the upper surface of the insulation film 16, and then etched to form the shapes of the support walls 18. Alternatively, the support walls 18 may be attached to the insulation film 16 through an anodic bonding process without using adhesive. The material of the support walls 18 can be selected with considerable freedom. It is desirable that the support walls 18 be formed from an inorganic material when the support walls 18 are attached to the insulation film 16 through the anodic bonding process.

After the support walls 18 are formed on the insulation film 16, as shown in FIG. 6(*c*), the common electrode 19 is formed on the plurality of support walls 18. The common electrode 19 is made from metal, for example, and is disposed to cover the entire substrate 1 in confrontation with all the individual electrodes 17. The single control line 19*a* is attached to the common electrode 19 for applying the voltage to the common electrode 19. As described already, the common electrode 19 and the individual electrodes 17 are applied with electric voltages to develop an electrostatic force, thereby deforming the cover film 15 vertically.

Thus, the liquid ejection device 100 (FIGS. 1(*a*) and 1(*b*)) of the present embodiment is produced.

As described above, according to the present embodiment, the silicon single crystal substrate 1 is formed with the plurality of channels 12 that are partitioned by the plurality of partition walls 11 and that are arranged at a pitch of 40 μm or less, for example. The filler material 13 is then introduced into the channels 12 to a height that matches the upper edges of the partition walls 11 and that extends flat between the partition walls 11. After the filler material 13 is hardened by heating, the cover film 15 is deposited to a thickness of 5 μm or less on the upper surface of the filler material 13 and on the upper edges of the partition walls 11. As a result, the cover film 15 has the same, flat shape as the upper surface of the filler material 13 and the upper edges of the partition walls 11. Next, the filler material 13 is removed so that the cover film 15 remains covering the channels 12. Next, the electrodes 17 are formed on the cover film 15. A drive voltage is applied between a desired electrode 17 and the common electrode 19 to deform the cover film 15 at a corresponding area, whereupon pressure is applied to liquid in the corresponding channel 12, and liquid is ejected from an aperture 12*a* that is provided at the front end of the subject channel 12. Thus, the compact and high density liquid ejection device 100 with a large deformation amount and with good drive efficiency can be easily manufactured.

Thus, according to the liquid election device 100 of the present embodiment, the plurality of channels 12 are formed in the substrate 1 in groove shapes partitioned by the partition walls 11. The cover film 15 with a thickness of 5 μm or less Is provided covering the channels 12. The pressure applying structure 16, 17, 18, and 19 is provided for deforming the cover film 15. Because the cover film 15 is extremely thin, the cover film 15 can be easily deformed to apply pressure to liquid in the channels 12 and allows the liquid to eject from the channels 12 with a high drive efficiency. Further, the liquid ejection device 100 can be produced in a desirable compact size.

Especially when the cover film 15 is deposited to the thickness of between 0.1 μm and 5 μm, drive can be efficiently performed and sufficient liquid ejection amount can be ensured. Especially when the cover film 15 is deposited to the thickness of 0.1 μm to 2 μm, the liquid ejection device 100 having even better ejection performance can be provided with only a short period of time required to perform the deposition process.

Because silicon material is used as the cover film 15, the liquid ejection device 100 which is not easily corroded by ink and other liquids can be produced using easy micromachining techniques.

The plurality of channels 12 can be formed in the substrate 1 as being aligned at the pitch of 40 μm or less. Because the plurality of channels 12 are aligned in a so high density, it is possible to realize. for example, an ink jet head with a plurality of nozzles aligned at a high density.

According to this embodiment, the electrodes 17 for applying voltages are provided on the cover film 15, and the counter electrode 19 is provided confronting the electrodes 17. Accordingly, the cover film 15 is easily deformed by electrostatic force to eject liquid. The cover film 15 can be deformed by a large displacement amount even with a low voltage drive.

Especially, the individual electrodes 17 are provided over the thin film, and the support walls 18 are provided to support the common electrode 19 above the cover film 15. The drive voltages for electrostatically deforming the cover film 15 is applied between the individual electrodes 17 on the cover film 15 and the common electrode 19 that is provided above the cover film 15 by way of the support walls 15. With this configuration, the electrodes 17 and 19 can be disposed close to each other to effectively produce a sufficient amount of electrostatic force.

According to the present embodiment, therefore, the cover film 15 can be electrostatically deformed when a drive voltage of an amount equal to or less than 50 volts is applied between the electrodes 17 and 19. Therefore, the liquid ejection device 1 of the present embodiment is capable of ejecting liquid efficiently using a low drive voltage. There is no need to supply a high drive voltage. Accordingly, the resultant liquid ejection device 100 can eject liquid by driving the cover film 15 using the control portion 200 with a simple circuit configuration. The entire liquid ejection system comprised from the liquid ejection device 100 and the control circuit 200 can be produced low costly.

According to the liquid ejection device 100 of the present embodiment. attraction and repulsion generated due to electrostatic forces can be used to deform the cover film 15 greatly between the condition when the cover film 15 protrudes upwards in the convex shape and the condition when the cover film 15 protrudes downwards in the concave shape. Ejection of liquids can be performed properly with good drive efficiency and with a large volume change in the channels 12. Also, because the cover film 15 can be formed in an extremely thin shape, only a relatively small drive voltage need be applied to eject liquid from the channels 12.

According to the liquid ejection device producing apparatus 1000 of the present embodiments the plurality of channels 12 are first formed in the substrate 1 in groove shapes as being partitioned by the partition walls 11. The filler material 13 is then introduced into all of the channels 12 to the height of the partition walls 11. The cover film 15 is then deposited on the partition walls and the filler material 13. Afterward, the filler material 13 is removed. Then, the pressure applying mechanism 16, 17, 18, and 19 is provided for deforming the cover film 15 to apply pressure to liquid filling the channels 12. Thus, the cover 15 of the channels 12 is formed in a movable thin film form. Liquid can therefore be pressurized with a good drive efficiency to be ejected. The liquid ejection device 100 is easily produced and can be produced in a compact size wherein the channels 12 are distributed at a high density.

Especially, according to the present embodiment, the liquid filler material 13 that hardens at the predetermined temperature is introduced into all the channels 12 so that the upper surface of the filler material reaches the upper edges of the partition walls 11 and becomes in a flat shape. Then, the filler material 13 is hardened by heating to the predetermined temperature. Afterward, the cover film 15 is deposited on top of the hardened filler material 13. The filler material 13 is then dissolved and removed using a solvent. These processes enable easy formation of the cover film 15 so that the liquid ejection device 100 can be manufactured at an even lower price.

Especially, before introducing the filler material 13 into the channels 12, the surfaces of the substrate 1 are treated to obtain high wettability with respect to the filler material 13. Therefore, the affinity of the substrate surface to the filler material 13 increases overall. Therefore, the filler material 13 can be introduced uniformly into the channels 12. Accordingly, the upper surface of the filler material becomes sufficiently flat, which enables forming the flat cover film 15 on the filler material 13.

After the affinity of the surface of the substrate 1 to the filler material 13 is made uniform overall, the filler material 13 is introduced in between the partition walls 11 until the upper surface matches with the upper edges of the partition walls 11. Accordingly. the filler material 13 is introduced in the channels 12 so that the surface of the filler material 13 becomes sufficiently flat. The cover film 15 is then deposited over the upper surface of the hardened filler material 13 and the upper edges of the partition walls 11. Then, the filler material 13 is removed. With this production method, the cover film 15 can be formed on the top of the partition walls 11 that partition the channels 12. The liquid ejection device 100 having the cover film 15 covering the channels 12 has a fairly complex configuration, but can be produced with comparative ease. The individual electrodes 17 are formed on the cover film 15 and the common electrode 19 is disposed in confrontation with the individual electrodes 17 so that the cover film 15 can function as a movable vibration plate. Thus, the liquid ejection device 100 having the complicated integral structure can be manufactured at a fairly low cost.

In the present embodiment, the cover film 15 extends flat covering the plurality of channels. However, the cover film 15 may have an undulating shape that has concave portions protruding inwardly into the channels 12 or convex portions protruding outwardly away from the channels 12 as will be described below for second and third embodiments.

[Second Embodiment]

A liquid ejection device 100 according to a second embodiment will be described below with reference to FIGS. 7(*a*)–10(*c*).

Figure 7A:
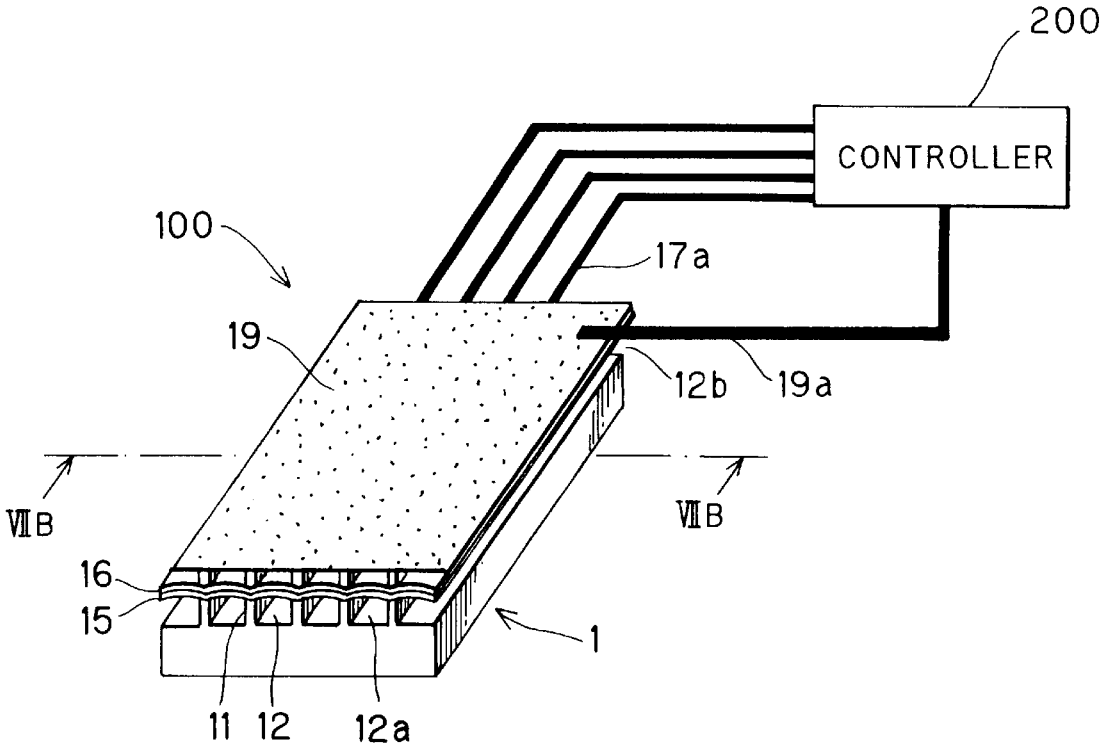
FIG. 7(*a*) is a perspective view showing a liquid ejection device according to a second embodiment of the present invention.
Figure 7B:
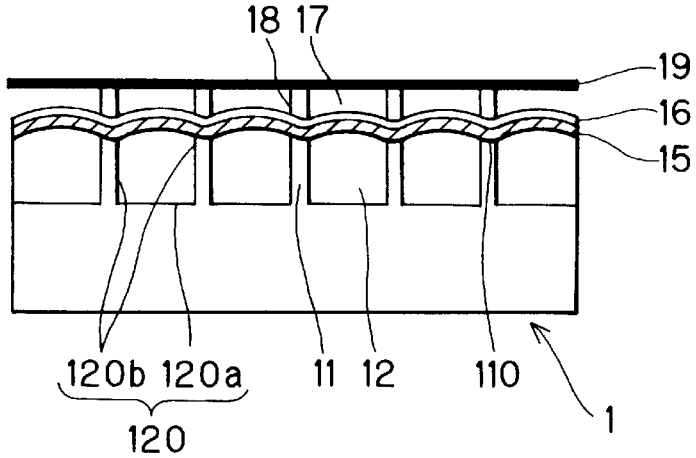

As shown in FIG. 7(*a*), the liquid ejection device 100 of the present embodiment is the same as that of the first embodiment except that the cover film 15 does not have a flat shape, but has an undulating shape. More specifically, as shown in FIG. 7(*b*), the cover film 15 has a convex-shaped cross-section at an area between each two adjacent partition walls 11. At an area between the upper edges of each two adjacent partition walls 11, the cover film 15 protrudes outwardly in a direction away from the bottom surface 120*a* of the corresponding channel 12.

With this structure, the liquid ejection device 100 of the present embodiment operates as described below.

Figure 8A:
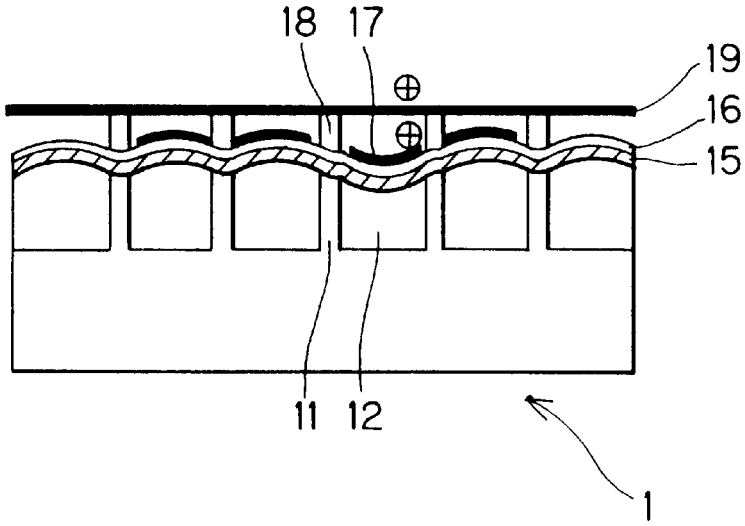
FIGS. 8(*a*) and 8(*b*) are cross-sectional views illustrating driving operations of the liquid ejection device of the second embodiment according to two types of driving manners, wherein FIG. 8(*a*) illustrates how a cover film is selectively deformed upon application of voltages of the same polarity to a common electrode and a selected individual electrode according to a first driving manner, and FIG. 8(*b*) illustrates how a cover film is selectively deformed upon application of voltages of the opposite polarities to the common electrode and the selected individual electrode according to a second driving manner.
Figure 8B:
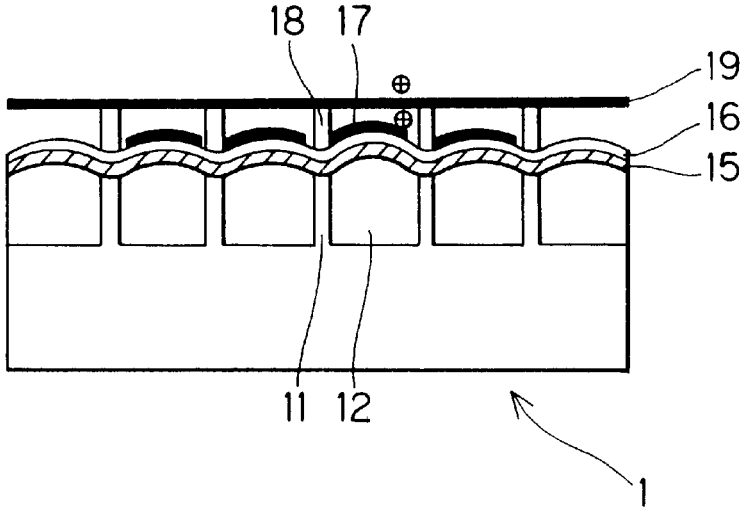
Figure 9A:
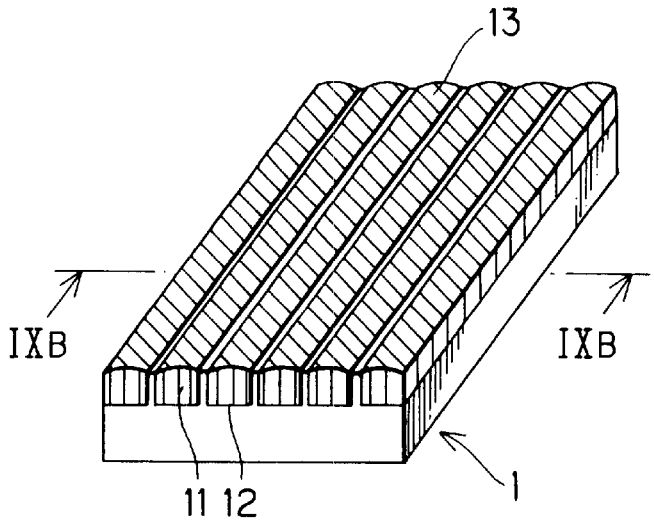
FIGS. 9(*a*) and 9(*b*) illustrate a process for introducing a filler material into the channels of the silicon single crystal substrate, wherein FIG. 9(*a*) is a perspective view showing the silicon single crystal substrate with filler material filling the inside of the channels.
Figure 9B:
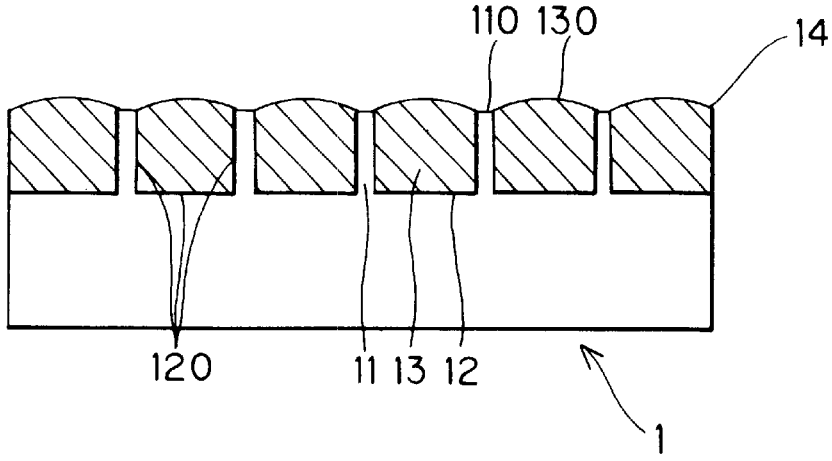
Figure 9C:
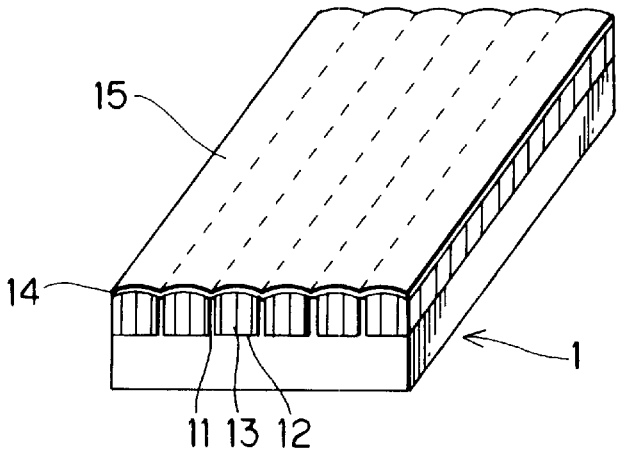
Figure 9D:
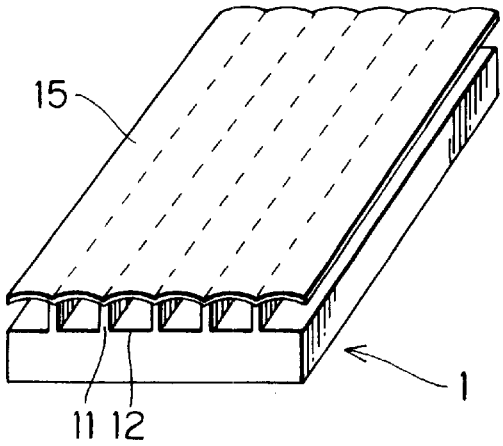

Similarly to the first embodiment, the liquid ejection device 100 of the present embodiment can operate both in the first driving manner (FIG. 8(*a*)) and the second driving manner (FIG. 8(*b*)).

According to the first driving manner, as shown in FIG. 8(*a*), voltages of the same polarity are applied to the common electrode 19 and a selected individual electrode 17.

The cover film 15 originally has an upwardly protruding shape as shown in FIG. 7(*b*) when no voltages are being applied to the common electrode 19 or to the corresponding individual electrode 17 When the voltages of the same polarity (positive polarity, in this example) are applied to the common electrode 19 and to the selected individual electrode 17, charges with the same positive polarity are developed on the electrodes 19 and 17. As a result, due to an electrostatic repulsion force, the cover film 15 is forced to deform, at the area formed with the energized individual electrode 17, so as to protrude downward inwardly into the corresponding channel 12 as shown in FIG. 8(*a*). As a result, the volume of the channel 12 decreases, and liquid is ejected through the ejection opening 12*a*. When application of the voltages is stopped, the cover film 15 restores its original shape, and the volume of the channel 12 increases, whereupon liquid is introduced into the channel 12 through the supply opening 12*b*.

It is noted that the difference between the original upward protruding condition (FIG. 7(*b*)) and the downward protruding condition (FIG. 8(*a*)) results in a large displacement, and therefore the volume of the corresponding channel 12 greatly changes. As a result, pressure can be effectively applied to liquid in the subject channel 12. Also, because the cover film 15 is originally formed in the upwardly-protruding convex shape as described above, the cover film 15 has a larger surface area than the case of the first embodiment where the cover film 15 is formed with a flat shape. Also in this respect, a larger deformation amount can be ensured.

According to the second driving manner, the common electrode 19 and a selected individual electrode 17 are applied with voltages of opposite polarities. When the common electrode 19 is applied with a voltage of the positive polarity and one selected individual electrode 17 is applied with a voltage of the negative polarity, charges with opposite polarities are developed on the electrodes 19 and 17. As a result, as shown in FIG. 8(*b*), due to an electrostatic attraction force, the portion of the cover film 15 that is formed with the energized individual electrode 17 deforms to protrude even more upwardly and further away from the corresponding channel 12 than normal. As a result. the volume of the channel 12 is slightly increased, upon which liquid is introduced into the channel 12 through the supply opening 12*b*. When application of the voltages to the electrodes 17 and 19 is stopped. the cover film 15 restores its original shape of FIG. 7(*b*), whereby the volume of the channel 12 decreases and liquid is ejected through the ejection opening 12*a*.

When the cover film 15 is driven in this second driving manner, that is, to protrude more when applied with the voltage than when no voltage is applied, a displacement is attained that is equivalent to the difference between the Initial protruding condition (FIG. 7(*b*)) to the largely protruding condition (FIG. 8(*b*)). At this time, only a slight vertical stress Is generated around the protruding shape in association with the vertical movement of the deforming cover film 15. As a result, drive can be efficiently performed. For example, this drive method is effective for ejecting small liquid droplets by slightly deforming the cover film 15 to protrude upward slightly more than the normally-upward protruding shape.

The liquid ejection device 100 of the present embodiment is produced also by the liquid ejection device producing apparatus 1000 of FIG. 3.

The substrate processing operation performed by the substrate processing portion 1100 according to the present embodiment is the same as that performed according to the first embodiment. Accordingly, also in the present embodiment, during the substrate processing process, the plurality of channels 12 are formed on the substrate 1 in the manner shown in FIGS. 4(*a*) and 4(*b*).

According to the present embodiment, the cover providing process performed by the cover providing portion 1200 is the same as that of the first embodiment except that according to the present embodiment, the cover film 15 is formed into the undulating shape of FIGS. 7(*a*) and 7(*b*).

In order to form the cover film 15 into the undulating shape, the cover providing process is executed In a manner described below.

According to the present embodiment, before introducing the filler material (resist material) 13 into the channels 12, it is desirable to process or treat the surface of the substrate 1 so that affinity to the resist material 13 of the upper edges 110 of the partition walls 11 will become different from affinity to the resist material 13 of the inner surfaces 120 of the channels 12.

In order to create the difference in affinity to the resist material 13 between the upper edges 110 of the partition walls 11 and the inner surfaces 120 of the channels 12, the inner surfaces 120 of the channels 12 and the upper edges 110 of the partition walls 11 are preferably subjected to different processes among treatments to increase hydrophilic nature and treatments to increase hydrophobic nature. More specifically, the resist used for the filler material 13 has a low affinity for water. Accordingly, treating the inner surfaces 120 of the channels 12 to increase their hydrophobic nature can increase their wettability with respect to the resist 13. Treating the upper edges 110 of the partition walls 11 to increase their hydrophilic nature can reduce their wettability with respect to resist 13.

According to the present embodiment, therefore. the upper edge of each partition wall 11 is subjected to a treatment to increase a hydrophilic nature. This decreases wettability of the partition wall upper edge 110 with respect to the resist material 13. The inner surfaces 120 of each channel 12 is subjected to a treatment to Increase a hydrophobic nature. This increases wettability of the channel inner surface 120 with respect to the resist material 13. As a result, the channel inner surface 120 has wettability, with respect to the filler material 13, higher than the upper edge surface 110 of each partition wall 11. After those treatments, the channels 12 are filled with the filler material 13. In this case, the filler material 13 will be more readily drawn to the inner surfaces 120 of the channels 12 than to the upper edges 110 of the partition walls 11. As a result, the upper surface of the filler material 13 will protrude outward with a convex shape in cross section as shown in FIG. 9(*a*).

When a normal positive resist is used as the filler material 13, it is sufficient to subject the upper edges 110 of the partition walls 11 to the treatments to increase their hydrophilic nature. More specifically, even just processing the upper edges 110 of the partition walls 11 to increase their hydrophilic nature will create a significant difference in affinity to the resist material 13 between the upper edges 110 of the partition walls 11 and the inner surfaces 120 of the channels 12.

Here, an example of how to produce this difference in affinity will be explained. Before the silicon single crystal substrate 1 is processed to form the channels 12 during the substrate processing step (FIGS. 4(*a*) and 4(*b*)), a film of metal such as tantalum that easily oxidizes is formed on the surface of the silicon single crystal substrate 1. Then, the channels 12 are formed on the surface of the silicon single crystal substrate 1 in the same manner as in the first embodiment (FIGS. 4(*a*) and 4(*b*)) so that the metal film be left on the upper edges of the partition walls 11. Because metal such as tantalum has a high hydrophilic nature, a large difference in wettability with respect to the resist 13 is created between the upper edges of the partition walls 11 and the inner surfaces of the channels 12. It is noted that tantalum can be etched together with the silicon substrate using fluoride type plasma. Accordingly, when tantalum is used, there is no need to change the contents of the substrate processing operation performed onto the silicon single crystal substrate 1.

Alternatively, only the inner surfaces 120 of the channels 12 may be treated to increase their hydrophobic nature.

It is noted that the optimum hydrophobic or hydrophilic processes will vary depending on the nature of the material used for the filler material 13. Therefore, it is desirable to perform processes most appropriate for the filler material 13. Also, there are some cases when no hydrophilic or hydrophobic processes need be performed.

Liquid resist that serves as the filler material 13 is poured into the channels 12 to level with the upper edges of the partition walls 11, and further until the filler material 13 bulges outward in a convex shape in cross section between the partition walls 11 as shown in FIGS. 9(*a*) and 9(*b*). More specifically, according to the present embodiment, the filler material 13 is poured into the channels 12 in an amount that is slightly greater than the volume of the channels 12, and that results in the upper surface curving by surface tension of the filler material 13 by a predetermined curve rate. Then, the substrate 1 whose channels 12 being filled with the filler material 13 is heated to the predetermined set temperature or greater so that the filler material 13 is hardened with the upper surface 130 being maintained in the upwardly protruding shape. As a result, as shown in FIG. 9(*b*), the upper surface 14 of the processed substrate 1 is produced in an undulating shaped by the upper edges 110 of the partition walls 11 and the curved upper surface 130 of the hardened filler material 13 which are arranged alternately. That is, the undulating surface 14 is formed from arched shapes repeated at the predetermined pitch wherein the lowest portion of the arched shapes is disposed on the upper edges 110 of the partition walls 11 and the highest portion of the arch shapes is at the center in between the partition walls 11.

As described already, in order to obtain the undulating surface 14, the filler material 13 is poured into the channels 12 in an amount that is slightly greater than the volume of the channels 12. It is preferable that the filler material 13 be a material that greatly expands when heated to be hardened. That is, it is preferable to use, as the filler material 13, a resist with a large expansion coefficient. When the resist with a large expansion coefficient is poured into the channels 12 and heated to harden, the volume of the filler material 13 increases and bulges out in the upwardly protruding arch from between the partition walls 11.

It is preferable to heat the filler material 13 to be hardened while inverting the substrate 1 upside down so that the exposed surface of the filler material 13 will face vertically downwardly from between the partition walls 11. With the substrate 1 in this orientation, due to the weight of the filler material 13 itself, the amount that the filler material 13 protrudes from between the partition walls 11 increases to an even greater extent.

By selectively combining the above-described methods, it Is possible to appropriately adjust the amount that the filler material 13, when hardened. protrudes from between the partition walls 11.

After the filler material 13 is hardened to provide the undulating upper surface 14 as shown in FIGS. 9(*a*) and 9(*b*), the cover film 15 is deposited over the undulating upper surface 14. The cover film 15 is deposited in the same manner as in the first embodiment. As a result, the cover film 15 is formed following the undulating shaped surface 14 as shown in FIG. 9(*c*).

Next, the filler material 13 is removed from the channels 12 In the same manner as in the first embodiment. As a result, as shown In FIG. 9(*d*), the channels 12 partitioned by the partition walls 11 are covered from above by the cover film 15. The cover film 15 is In intimate sealing contact with the upper edges of the partition walls 11 and protrudes outward away from the channels 12 at positions between the partition walls 11. The volume of the channels 12 is increased by the amount that the cover film 15 protrudes outward. in comparison with the case of the first embodiment where the cover film 15 is flat.

According to the present embodiment, the electrode providing process performed by the electrode providing portion 1300 is the same as that of the first embodiment except that according to the present embodiment the electrodes 17 and 19 are provided to the cover film 15 of the undulating shape.

In order to provide the electrodes 17 and 19 to the cover film 15 of the undulating shape, the electrode providing process is executed as described below.

Figure 10A:
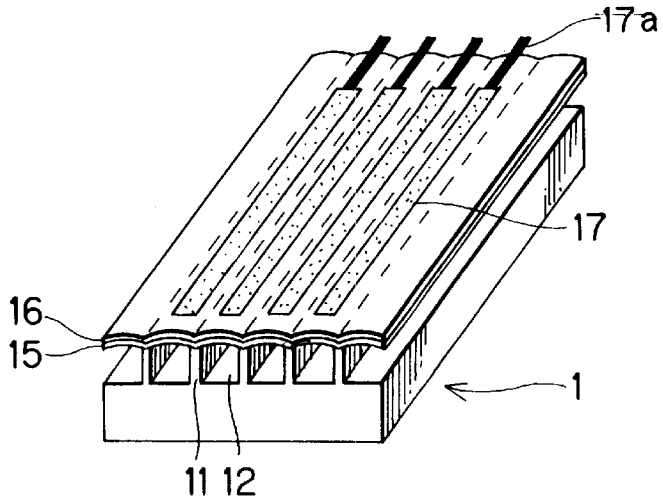
FIGS. 10(*a*), 10(*b*), and 10(*c*) are perspective views illustrating a process for forming electrodes on the upper surface of the cover film, wherein FIG. 10(*a*) is a perspective view showing a plurality of individual electrodes that are formed on the cover film via an insulation film so as to be located above and to extend following the plurality of channels, FIG. 10(*b*) is a perspective view showing a plurality of support walls attached to the top of the insulation film at positions between the individual electrodes, and FIG. 10(*c*) is a perspective view showing a common electrode formed on and supported by the plurality of support walls.
Figure 10B:
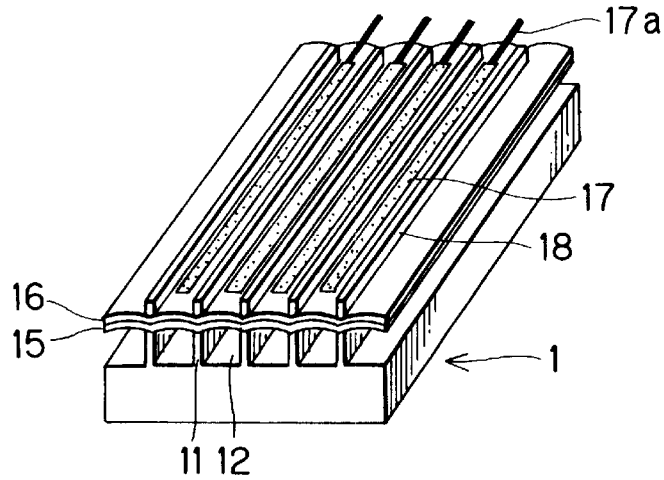
Figure 10C:
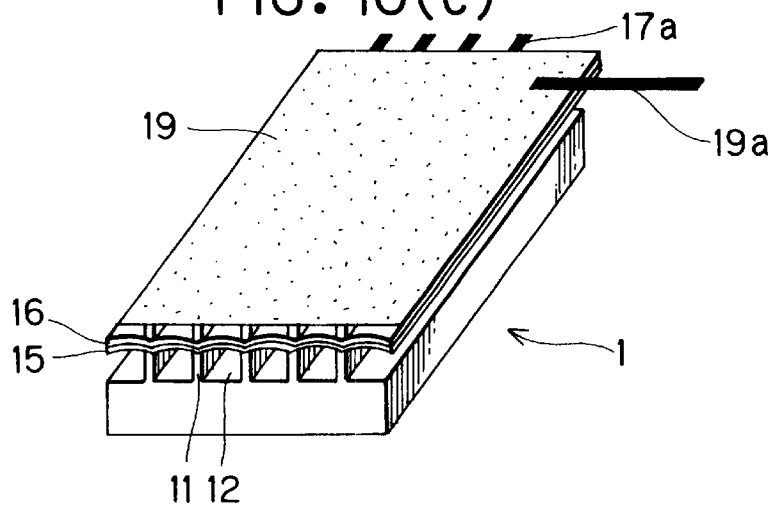

First, in the same manner as in the first embodiment, the insulation film 16 is provided over the cover film 15, and the plurality of individual electrodes 17 are provided over the insulation film 16 in the same manner as in the first embodiment. As shown in FIG. 10(*a*), the insulation film 16 follows the undulating shape of the cover film 15.

Then, as shown in FIG. 10(*b*), the plurality of support walls 18 are formed over the Insulation film 16 in the same manner as in the first embodiment. It is noted that the support walls 18 should be formed to a height that is sufficiently greater than the amount that the insulation film 16 protrudes highest upward between the partition walls 11. Then, as shown in FIG. 10(*c*), the common electrode 19 is provided over the support walls 18 in the same manner as in the first embodiment. Thus, the liquid ejection device 100 of the present embodiment is obtained.

As described above, according to the present embodiment, the silicon single crystal substrate 1 is formed with the plurality of channels 12 that are partitioned by the plurality of partition walls 11. The filler material 13 is then introduced into the channels 12 to a height that matches the upper edge of the partition walls 11 and that protrudes further upward between the partition walls 11. After the filler material 13 is hardened by heating, the cover film 15 is deposited on the upper surface of the filler material 13 and on the upper edges of the partition walls 11. As a result, the cover film 15 has the same, upwardly-protruding shape as the upper surface of the filler material 13 and the upper edges of the partition walls 11 Next, the filler material 13 is removed so that the cover film 15 remains covering the channels 12. Next, the electrodes 17 are formed on the cover film 15. A drive voltage is applied between a desired electrode 17 and the common electrode 19 to deform the cover film 15 at the corresponding area, whereupon pressure is applied to liquid in the corresponding channel 12, and liquid is ejected from an aperture 12*a* that is formed at the front end of the subject channel 12. Thus, the compact and high density liquid ejection device 100 with a large deformation amount and with good drive efficiency can be easily manufactured.

Thus, according to the present embodiment, the plurality of channels 12 are formed, in the substrate 1, in groove shapes partitioned by the partition walls 11. The cover film 15 for covering all the channels 12 is deposited over the upper edges of the partition walls 11. The cover film 15 has an upwardly protruding and convex shape in cross section between adjacent partition walls 11. The pressure applying mechanism 16, 17, 18, 19 is provided for deforming the cover film 15 to apply pressure to liquid in the channels 12. With this configuration, the cover of the channels 12 is formed as a movable cover film 15 and therefore a sufficiently large displacement amount can be attained. Also, liquid can be ejected from the channels 12 upon application of pressure to liquid with a proper drive efficiency. The liquid ejection device 100 with a high density distribution of nozzles with a compact size can therefore be obtained with good yield.

The individual electrodes 17 are provided directly over the cover film 15. The common electrode 19 is supported by the support walls 18 to be disposed above the individual electrodes 17 on the cover film 15. Because the cover film 15 has the upwardly-protruding convex shape, the electrodes 17 and 19 can be disposed even closer to each other. and stress accompanying deformation of the cover film 15 that is developed due to the electrostatic force generated between the electrodes 17 and 19 can be reduced so that a highly efficient thin film drive with a large displacement amount can be attained.

When the device 100 is driven in the first driving manner of FIG. 8(*a*), the electrostatic attraction and repulsion forces can be used to deform the cover film 15 greatly from the initial condition when the cover film 15 protrudes upwards in the convex shape to the condition when the cover film 15 protrudes downwards in the concave shape. Ejection of liquids can be performed properly with good drive efficiency and with a large volume change in the channels 12. Because the cover film 15 can be formed in an extremely thin shape, only a relatively small drive voltage need be applied to eject liquid from the channels 12.

Particularly, in comparison with the case of the first embodiment where the cover film 15 is flat, a smaller gap exists between the common electrode 19 and the upwardly-protruding cover film 15 in the normal condition of FIG. 7(*b*). Accordingly, even a smaller drive voltage is required to drive the cover film 15 of the present embodiment.

Additionally, the surface area of the upwardly-protruding cover film 15 is larger in comparison with the case of the first embodiment where the cover film 15 is flat. Accordingly, even a larger deformation amount can be obtained, and more efficient drive can be attained.

According to the liquid ejection device production process of the present embodiment, the plurality of channels 12 are first formed in the substrate 1 in groove shapes partitioned by the partition walls 11. The filler material 13 is then introduced into all of the channels 12 up to the upper edges of the partition walls 11 until the upper surface of the filler material 13 has an upwardly-protruding and convex shape in cross section between each two adjacent partition walls 11. The cover film 15 is then deposited on the top of the filler material 13. Next, the filler material 13 is removed from the channels 12. The pressure applying mechanism 16, 17, 18, and 19 is then provided for deforming the cover film 15 to apply pressure to liquid in the channels 12.

The liquid ejection device 100 formed following the above-described order of manufacturing processes can eject liquid by applying pressure using a large deformation amount and a good drive efficiency using the extremely thin movable cover film 15. The liquid ejection device 100 can be produced in a compact size with a very high density distribution of nozzles. The liquid ejection device 100 can be manufactured at low cost.

Especially. according to the present embodiment. the liquid filler material 13 that hardens at the predetermined temperature is introduced into all the channels 12 until the upper surface of the filler material 13 is in the convex shape between each two adjacent partition walls 11. Then, the filler material 13 is hardened by heating to the predetermined temperature. Afterward, the cover film 15 Is deposited on top of the hardened filler material 13. The filler material 13 is then dissolved and removed using a solvent. These processes enable easy formation of the cover film 15 so that the liquid ejection device 100 can be manufactured at an even lower cost.

Especially. when the filler material 13 that expands when heated is used, the filler material expands to increase its volume while being heated to be hardened As a result, the upper surface of the filler material 13 bulges out from the channels 12 and naturally forms the outwardly-protruding convex shape in cross section. Accordingly, the upper surface of the thin film 13 can be easily formed in a convex shape in cross section. Also, by adjusting the expansion coefficient of the filler material 13, the degree of that the convex shape protrudes can be easily changed. This enables easy production of the liquid ejection device 100 with a large displacement amount and good drive efficiency.

Especially, when the liquid ejection device 100, with filler introduced into the channels 12, is turned upside down and heated to harden the filler material, the filler material 13 protrudes out from the channels 12 by its own weight so that the outwardly-protruding convex shape increases even further. As a result, the liquid ejection device 100 can be easily produced with an even larger deformation amount and even better drive efficiency.

Before the filler material 13 is introduced into the channels 12, the surface treatments are performed on the surfaces of the channels 12 to raise its wettability with respect to the filler material 13 to a relatively high degree, and are performed on the upper edges of the partition walls 11 to reduce its wettability to a relatively low degree. As a result, the affinity of the inner surfaces 120 of the channels 12 to the filler material 13 is increased and the affinity of the upper edges 110 of the partition walls to the filler material 13 is decreased. Therefore, the upper protruding convex shape is easy to form so that production is easy.

Thus, according to the present embodiment, the filler material 13 is introduced in between the partition walls 11 until the upper surface protrudes above the partition walls 11. The cover film 15 is then deposited over the protruding upper surface of the hardened filler material 13. Then, the filler material 13 is removed from the channels 12. With this production methods the cover film 15 can be formed on the top of the partition walls 11 that partition the channels 12. The liquid ejection device 100, with the cover film 15 of the undulating shape covering the channels 12, has a fairly complex configuration, but can be produced with comparative ease. The individual electrodes 17 are formed on the cover film 15 and the common electrode 19 is disposed in confrontation with the individual electrodes 17 so that the cover film 15 can function as a movable, vibration plate. As a result, the liquid ejection device 100 having the complicated integral structure can be manufactured at a fairly low cost.

[Third Embodiment]

A liquid ejection device 100 according to a third embodiment will be described below with reference to FIGS. 11(*a*)–14(*b*).

The liquid ejection device 100 of the present embodiment is the same as that of the second embodiment except for the points described below.

Figure 11A:
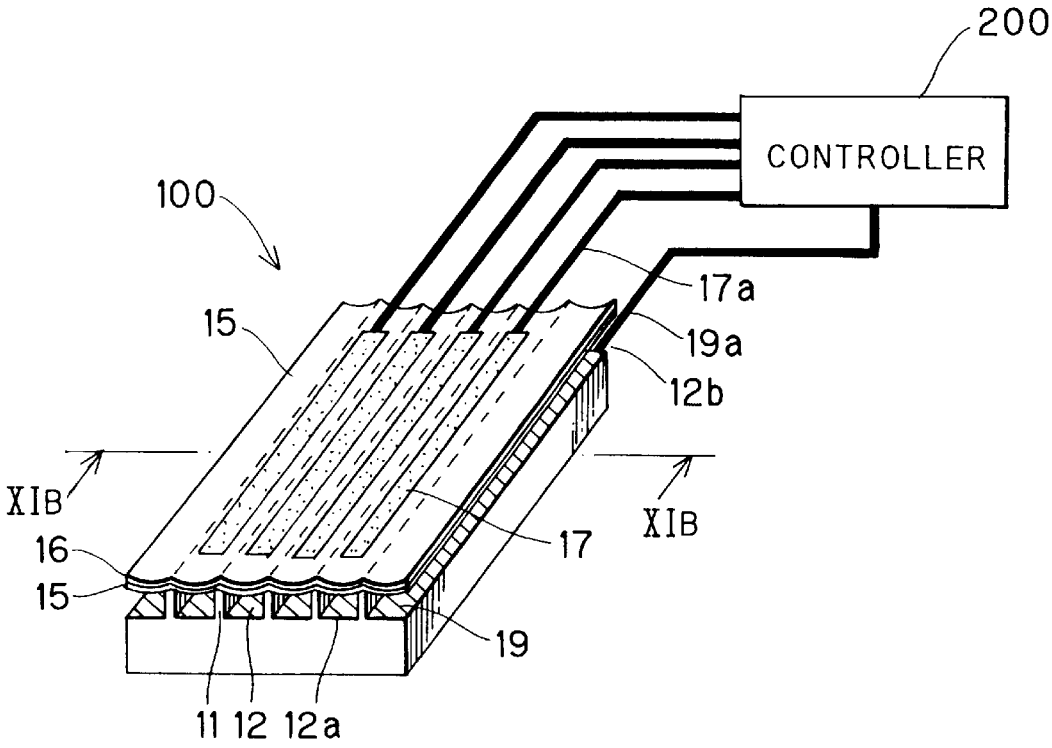
FIG. 11(*a*) is a perspective view showing a liquid ejection device according to a third embodiment of the present invention.
Figure 11B:
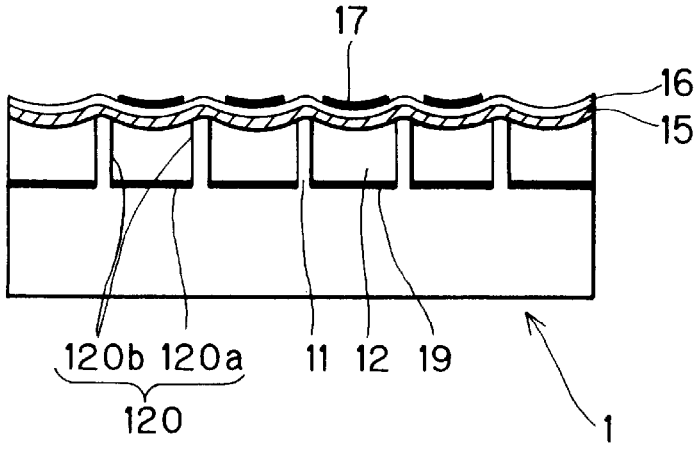

First, as shown in FIGS. 11(*a*) and 11(*b*), the cover film 15 is formed in an undulating shape to protrude, at an area between each two adjacent partition walls 11, downwardly inwardly into the respective channels 12. More specifically. the cover film 15 has a concave-shaped cross-section at an area between each two adjacent partition walls 11. At an area between each two adjacent partition walls 11, the cover film 15 protrudes inwardly in a direction toward the bottom surface 120*a* of the corresponding channel 12.

Secondly, the common electrode 19 is formed on the bottom surface 120*a* of the channels 12 in confrontation with the cover film 15.

With the above-described structure, the liquid ejection device 100 of the present embodiment operates as described below.

Also according to the present embodiment, the liquid ejection device 100 can be driven both in the first driving manner and the second driving manner.

Figure 12A:
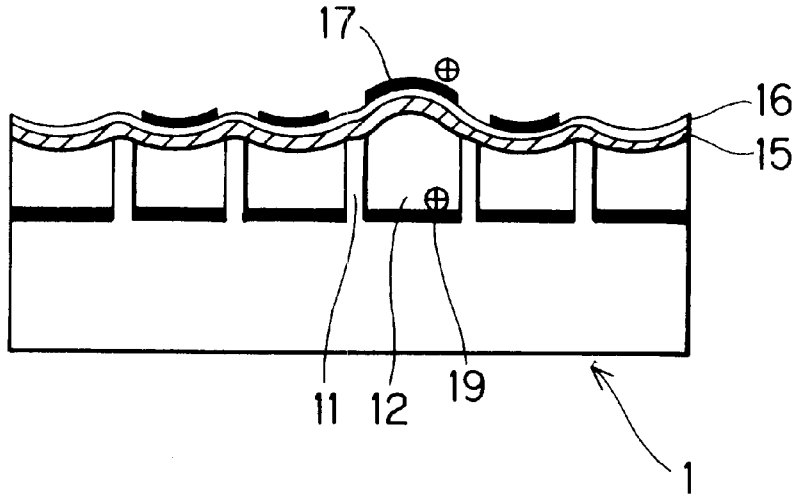
FIGS. 12(*a*) and 12(*b*) are cross-sectional views illustrating driving operations of the liquid ejection device of the third embodiment according to two types of driving manners, wherein FIG. 12(*a*) illustrates how a cover film is selectively deformed upon application of voltages of the same polarity to a common electrode and a selected individual electrode according to a first driving manner, and FIG. 12(*b*) illustrates how a cover film is selectively deformed upon application of voltages of the opposite polarities to the common electrode and the selected individual electrode according to a second driving manner.
Figure 12B:
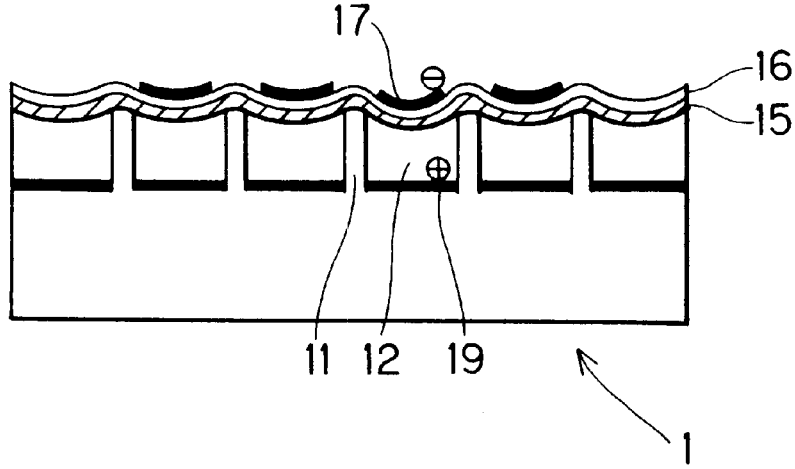
Figure 13A:
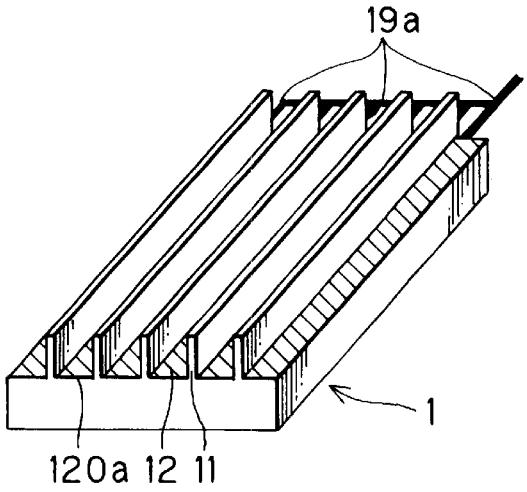
FIG. 13(*a*) is a perspective view illustrating a process for forming a common electrode over the bottom surfaces of the plurality of channels.
Figure 13B:
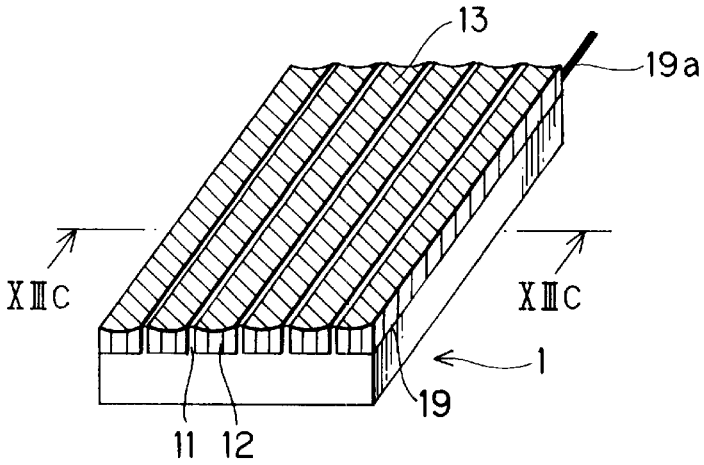
Figure 13C:
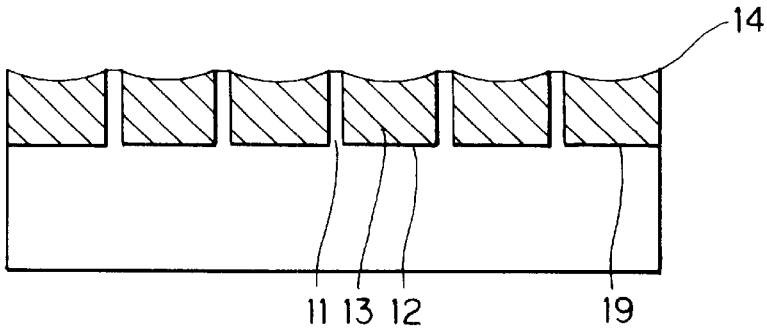
Figure 13D:
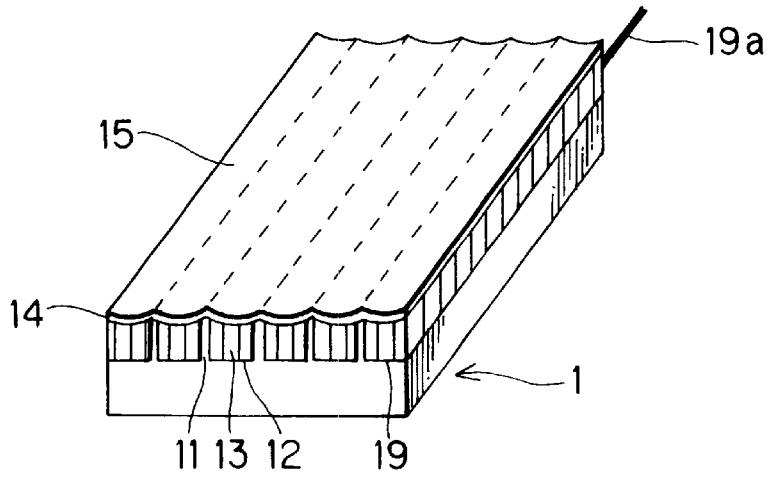
Figure 13E:
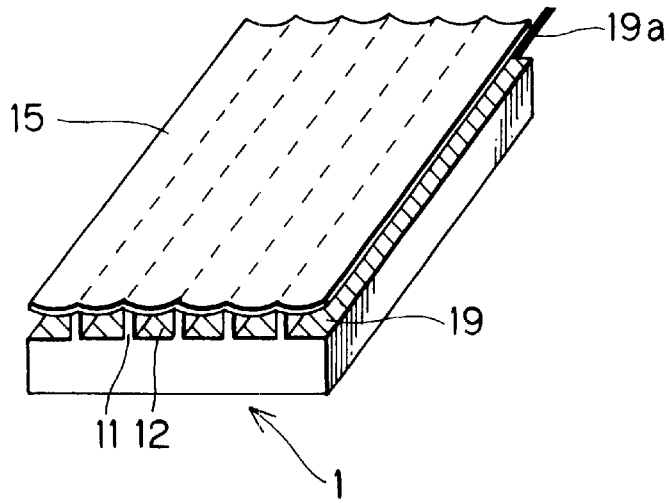

According to the first driving manner, in order to control one desired channel 12 to eject liquid, the common electrode 19 and the corresponding individual electrode 17 are applied with voltages of the same polarity (positive polarity, for example) as shown in FIG. 12(*a*). Positive charges developed on both of the individual electrode 17 and the common electrode 19 repel each other due to electrostatic repulsion. The portion of the film 15 that covers the channel 12 below the energized individual electrode 17 deforms into a convex shape that protrudes away from the bottom surface of channel 12. As a result, the volume of the subject channel 12 is increased, and the pressure in the channel 12 is reduced. Liquid is therefore introduced into the channel 12 through the supply opening 12*b*. When application of the voltages to the common electrode 19 and the individual electrode 17 Is stopped, the cover film 15 returns to its initial shape (FIG. 11(*b*)), whereby the volume of the channel 12 reduces. Pressure applied in the channel 12 increases. and liquid is ejected from the channel 12 through the ejection opening 12*a*.

Similarly to the second embodiment, the difference between the original downward protruding condition (FIG. 11(*b*)) and the upward protruding condition (FIG. 12(*a*)) results in a large displacement, and therefore the volume of the corresponding channel 12 greatly changes. As a result, pressure can be effectively applied to liquid in the subject channel 12. Also, because the cover film 15 is originally formed in the downwardly-protruding concave shape as described above, the cover film 15 has a large surface area. Also in this respect, a large deformation amount can be ensured.

According to the second driving manner. in order to eject liquid from some desired channel, the common electrode 19 and the corresponding individual electrode 17 are applied with voltages of the opposite polarities. In this example, the common electrode 19 is applied with a voltage with the positive polarity, and the individual electrode 17 is applied with another voltage with the negative polarity. As a result, as shown in FIG. 12(*b*), electric charges with opposite polarities are developed on the individual electrode 17 and the common electrode 19 and are electrostatically attracted to each other. The portion of the film 15 that covers the channel 12 below the energized individual electrode 17 therefore deforms to protrude even further downward toward the bottom surface of the channel 12 than normal. As a result, the volume of the channel 12 is reduced, and liquid is ejected from the channel through the ejection opening 12*a*.

When the cover film 15 is driven in this second driving manner, that is, to protrude more when applied with the voltage than when no voltage is applied, a displacement is attained that is equivalent to the difference between the initial protruding condition (FIG. 11(*b*)) to the largely protruding condition (FIG. 12(*b*)). At this time, only a slight vertical stress Is generated around the protruding shape in association with the vertical movement of the deforming cover film 15. Additionally, the distance between the cover film 15 and the common electrode 19 decreases when the cover film 15 deforms to further protrude inwardly toward the bottom surface. Accordingly, drive can be efficiently performed. For example, this drive method is effective for ejecting small liquid droplets by slightly deforming the cover film 15 to protrude downward slightly more than the normally-downward protruding shape.

The liquid ejection device 100 of the present embodiment is produced also by the liquid ejection device producing apparatus 1000 of FIG. 3.

The substrate processing operation performed by the substrate processing portion 1100 according to the present embodiment is the same as that performed according to the first and second embodiments. Accordingly, also in the present embodiment, during the substrate processing step, the plurality of channels 12 are formed on the substrate 1 in the manner shown in FIGS. 4(*a*) and 4(*b*).

According to the present embodiment, the cover providing process performed by the cover providing portion 1200 is the same as that of the second embodiment except for the points described below.

According to the present embodiment, the common electrode 19 is provided over the bottom surface 120*a* of each channel 12 before the filler material 13 is introduced into the channel 12. More specifically, as shown in FIG. 13(*a*), a plurality of separate electrodes 19 are provided over the bottom surfaces 120*a* of the respective channels 12 before the filler material 13 is introduced into the channels 12. The electrodes 19 are formed so as to cover the entire bottom surfaces 120*a* of the respective channels 12. Separate control wires 19*a*, 19*a*, . . . are connected to the electrodes 19 in the respective channels 12. An insulating material is then formed on the top surface of each electrode 19 so that the electrode 19 will not come into direct contact with liquid filling the channel 12. It is noted that the electrodes 19 thus provided over the bottom surfaces 120*a* of the respective channels 12 are separated from one another. Those electrodes 19 are, however, electrically connected together to serve as the single common electrode 19 because the control wires 19*a*, 19*a*, . . . for all the electrodes 19 are connected together as a single control wire 19*a* as shown in FIG. 13(*a*). The single control wire 19*a* will be connected to the control portion 200 as shown in FIG. 11(*a*).

After the common electrode 19 is thus formed on the bottom surfaces of the channels 12, the filler material 13 is introduced into the channel 12 so that the upper surface of the filler material 13 will have a concave-shaped cross-section between each two adjacent partition walls 11. That is, liquid resist that serves as the filler material 13 is poured into the entire channels 12 so that its upper surface 130 will match with the upper edges 110 of the partition walls 11 but will protrude downwardly inwardly into the channels 12 between the partition walls 11 as shown in FIGS. 13(*b*) and 13(*c*).

More specifically, the filler material 13 is poured into the channels 12 in an amount that is slightly smaller than the volume of the channels 12. If the surface tension of the filler material 13 is relatively small, the filler material 13 clings to the partition walls 11 so that the upper surface of the filler material 13 will protrude downward in a sufficiently deep concave shape. It is noted that if the surface tension of the filler material 13 is not small, a surfactant is mixed In the filler material 13 in order to reduce the surface tension of the filler material 13. Accordingly, the filler material 13 will cling to the partition walls 11 and the upper surface of the filler material 13 will protrude downward in a sufficiently deep concave shape. The wettability of the surface of the partition walls 11 with respect to the filler material 13 is preferably maintained at an appropriate level.

Then, the substrate 1 whose channels 12 are filled with the filler material 13 is heated to the predetermined set temperature or greater. As a result, the filler material 13 Is hardened with its upper surface 130 being maintained in the downwardly-protruding shape. As a result, as shown in FIG. 13(*c*), the upper surface 14 of the processed substrate 1 is produced in an undulating shape defined by the upper edges 110 of the partition walls 11 and the curved upper surface 130 of the hardened filler material 13 which are arranged alternately. That is, the undulating surface 14 is formed from arched shapes repeated at the predetermined pitch wherein the highest portion of the arched shapes is disposed on the upper edges of the partition walls 11 and the lowest portion of the arch shapes is at the center in between the partition walls 11.

According to the present embodiment, the filler material 13 In an amount slightly less than the volume of the channels 12 is introduced Into the channels 12 Accordingly, the filler material 13 has the downwardly-protruding concave form In its upper surface 130 at areas between the partition walls 11. In order to provide this downwardly-protruding concave form, it is preferable to use, as the filler material 13, a material that decreases in volume when hardened through the heating process. Such a filler material 13 can be prepared by increasing the ratio of solvent included in the resist. When the resist is hardened by heating, the solvent will evaporate and the volume of the filler material 13 will decrease. The downwardly-protruding concave form in the upper surface of the filler material 13 between the partition walls 11 can become much deeper.

Similarly to the second embodiment, before the filler material 13 is introduced into the channels 12, the inner surfaces 120 of the channels 12 and the upper edges 110 of the partition walls 11 may preferably be treated to have different affinity with respect to the filler material 13. That is. the upper edge 110 of each partition wall 11 is subjected to the hydrophilic treatment so as to decrease wettability of the partition wall upper edge 110 with respect to the resist material 13. The Inner surfaces 120 of each channel 12 is subjected to the hydrophobic treatment so as to increase wettability of the channel Inner surface 120 with respect to the resist material 13. As a result, the inner surface 120 of each channel 12 has wettability. with respect to the filler material 13, higher than the upper edge surface 110 of each partition wall 11. In this case, when the channels 12 are filled with the filler material 13, the filler material 13 will be more readily drawn to the inner surfaces 120 of the channels 12 than to the upper edges 110 of the partition walls 11. As a result, the upper surface of the filler material 13 will protrude inward with a concave shape in cross section as shown in FIGS. 13(*b*) and 13(*c*). It is noted that the various methods, employed in the second embodiment, for creating the significant difference in affinity to the resist material 13 between the inner surfaces of the channels 12 and the upper edges of the partition walls 11 can be employed also according to the present embodiment.

The above-described various methods can be used in combination to appropriately adjust the amount that the undulating surface 14 protrudes downward.

After the filler material 13 is hardened to provide the undulating upper surface 14 as shown in FIGS. 13(*b*) and 13(*c*), the cover film 15 is deposited over the undulating upper surface 14. The cover film 15 is deposited in the same manner as in the first and second embodiments. As a result, the cover film 15 is formed following the undulating shaped surface 14 as shown in FIG. 13(*d*). Next, the filler material 13 is removed from the channels 12 in the same manner as in the first and second embodiments. As a result, the channels 12 partitioned by the partition walls 11 are covered from above by the cover film 15. The cover film 15 is in intimate sealing contact with the upper edges of the partition walls 11 and protrudes downwardly into the channels 12 at positions between the partition walls 11. The volume of the channels 12 is decreased by the amount that the cover film 15 protrudes inward. in comparison with the case of the first embodiment where the cover film 15 is flat.

According to the present embodiment, the electrode providing process performed by the electrode providing portion 1300 is the same as that of the second embodiment except that the common electrode 19 is already provided to the bottom surfaces of the channels 12.

Figure 14A:
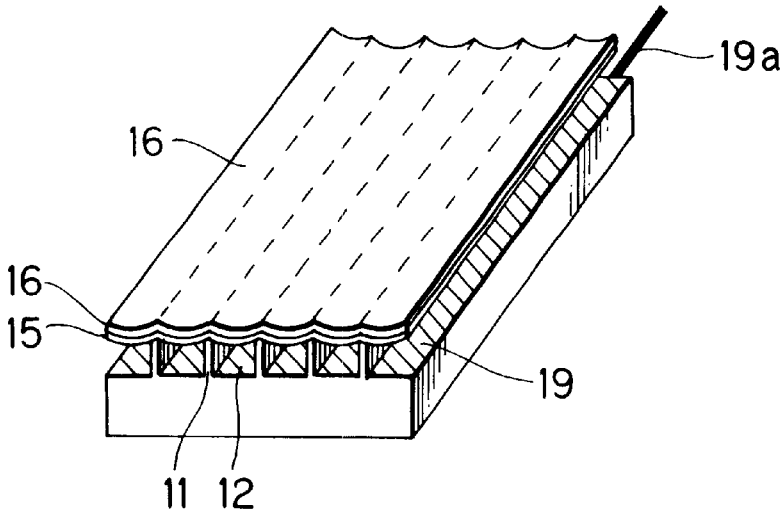
FIGS. 14(*a*) and 14(*b*) are perspective views illustrating a process for forming electrodes on the upper surface of the cover film, wherein FIG. 14(*a*) is a perspective view showing an insulation film provided over the cover film, and FIG. 14(*b*) is a perspective view showing a plurality of individual electrodes that are formed on the cover film via the insulation film so as to be located above and to extend following the plurality of channels.
Figure 14B:
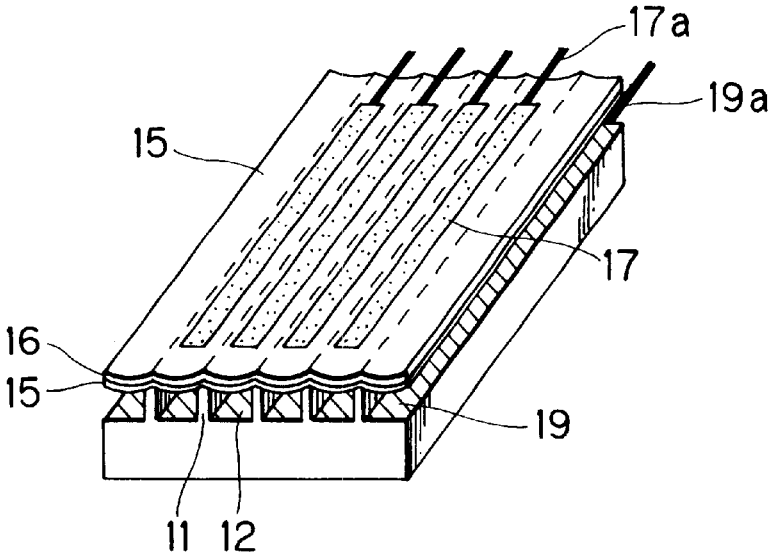

In order to provide the electrodes 17 to the cover film 15 of the undulating shape, in the same manner as in the second embodiment. the insulation film 16 is provided over the cover film 15. As shown in FIG. 14(*a*), the insulation film 16 follows the undulating shape of the cover film 15. Then, the plurality of individual electrodes 17 are provided over the insulation film 16 as shown in FIG. 14(*b*). The individual electrodes 17 are provided over the insulation film 16 in the same manner as in the first and second embodiments.

Thus, the liquid ejection device 100 of the present embodiment is obtained.

As described above, according to the present embodiment. the silicon single crystal substrate 1 is formed with the plurality of channels 12 that are partitioned by the plurality of partition walls 11. The filler material 13 is then introduced into the channels 12 to a height that matches the upper edge of the partition walls 11 and that protrudes downward between the partition walls 11. After the filler material 13 is hardened by heating, the cover film 15 is deposited on the upper surface of the filler material 13 and on the upper edges of the partition walls 11. As a result, the cover film 15 has the same, downwardly-protruding shape as the upper surface of the filler material 13 and the upper edges of the partition walls 11. Next, the filler material 13 is removed so that the cover film 15 remains covering the channels 12. Next, the electrodes 17 are formed on the cover film 15. A drive voltage is applied between a desired electrode 17 and the common electrode 19 to deform the cover film 15 at the corresponding area, whereupon pressure is applied to liquid in the corresponding channel 12, and liquid is ejected from an aperture 12*a* that is formed at the front end of the subject channel 12. Thus. the compact and high density liquid ejection device 100 with a large deformation amount and with good drive efficiency can be easily manufactured.

Thus, according to the present embodiment. the plurality of channels 12 are formed, in the substrate 1, in groove shapes partitioned by the partition walls 11. The cover film 15 for covering all the channels 12 is deposited over the upper edges of the partition walls 11. The cover film 15 has a downwardly protruding and concave shape in cross section between adjacent partition walls 11. The pressure applying mechanism 16, 17, 18, 19 is provided for deforming the cover film 15 to apply pressure to liquid in the channels 12. With this configuration, the cover of the channels 12 is formed as a movable cover film 15 and therefore a sufficiently large displacement amount can be attained. Also, liquid can be ejected from the channels 12 upon application of pressure to liquid with a proper drive efficiency. The liquid ejection device 100 with a high density distribution of nozzles with a compact size can therefore be obtained with good yield.

The individual electrodes 17 are provided over the cover film 15, and the common electrode 19 is provided below the cover film 15 and on the bottom surface of each channel 12. A drive voltage for electrostatically deforming the cover film 15 is applied between the electrodes 17 and 19. With this configuration, the electrodes 17 on the cover film 15 and the common electrode 19 at the bottom surface of the channels 12 can be disposed close to each other. Also, because the cover film 15 has a concave shape that protrudes toward the bottom surface of each channel 12, the electrodes 17 and 19 can be provided even closer to each other. Stress generated by deformation developed by operation of the electrodes 17 and 19 can be reduced, and the cover film 15 can be more efficiently driven with a larger deformation amount.

According to the liquid ejection device 100 of the present embodiment, the electrostatic attraction and repulsion forces can be used to deform the cover film 15 greatly from the initial condition when the cover film 15 protrudes downwards in the concave shape to the condition when the cover film 15 protrudes upwards In the convex shape. Ejection of liquids can be performed properly with good drive efficiency and with a large volume change in the channels 12. Because the cover film 15 can be formed In an extremely thin shape. only a relatively small drive voltage need be applied to eject liquid from the channels 12.

Additionally, the surface area of the downwardly-protruding cover film 15 is larger in comparison with the case of the first embodiment where the cover film 15 is flat.

Accordingly, even a larger deformation amount can be obtained, and more efficient drive can be attained.

According to the liquid ejection device production process of the present embodiment, the plurality of channels 12 are first formed in the substrate 1 in groove shapes partitioned by the partition walls 11. The filler material 13 is then introduced into all of the channels 12 up to the upper edges of the partition walls 11 until the upper surface of the filler material 13 has a downwardly-protruding and concave shape in cross section between each two adjacent partition walls 11. The cover film 15 is deposited on the top of the filler material 13. Next, the filler material 13 is removed from the channels 12. The pressure applying mechanism 16, 17, 18, and 19 is then provided for deforming the cover film 15 to apply pressure to liquid in the channels 12.

The liquid ejection device 100 formed following the above-described order of manufacturing processes can eject liquid by applying pressure using a large deformation amount and a good drive efficiency using the extremely thin movable cover film 15. The liquid ejection device 100 can be produced in a compact size with a very high density distribution of nozzles. The liquid ejection device 100 can be manufactured at low cost.

Especially, according to the present embodiment, the liquid filler material 13 that hardens at the predetermined temperature is introduced into all the channels 12 until the upper surface of the filler material 13 is in the concave shape between each two adjacent partition walls 11. Then, the filler material 13 is hardened by heating to the predetermined temperature. Afterward, the cover film 15 is deposited on top of the hardened filler material 13. The filler material 13 is then dissolved and removed using a solvent. These processes enable easy formation of the cover film 15 so that the liquid ejection device 100 can be manufactured at an even lower cost.

Especially, when the filler material 13 that reduces its volume while being heated is used, the upper surface of the filler material 13 naturally forms the inwardly-protruding concave shape in cross section. Accordingly, the upper surface of the filler material 13 can be easily formed in a concave shape in cross section. Also, by adjusting the ratio of solvent in the filler material 13, the depth of the concave shape can be easily changed. This enables easy production of the liquid ejection device 100 with a large displacement amount and good drive efficiency.

Before the filler material 13 is introduced into the channels 12. the surface treatments are performed on the surfaces 120 of the channels 12 to raise its wettability with respect to the filler material 13 to a relatively high degree, and are performed on the upper edges 110 of the partition walls 11 to reduce its wettability to a relatively low degree. As a result. the affinity of the inner surfaces 120 of the channels 12 to the filler material 13 is increased. Therefore, the downwardly-protruding concave shape is easy to form so that production is easy.

Thus, according to the present embodiment, the filler material 13 is introduced in between the partition walls 11 until the upper surface protrudes down the partition walls 11. The cover film 15 is then deposited over the downwardly-protruding upper surface of the hardened filler material 13. Then, the filler material 13 is removed from the channels 12. With this production method, the cover film 15 can be formed on the top of the partition walls 11 that partition the channels 12. The liquid ejection device 100 with the cover film 15 of the undulating shape covering the channels 12 has a fairly complex configuration, but can be produced with comparative ease. The individual electrodes 17 are formed on the cover film 15 and the common electrode 19 is disposed on the bottom surface of the channels 12 in confrontation with the individual electrodes 17 so that the cover film 15 can function as a movable, vibration plate. As a result, the liquid ejection device 100 having the complicated integral structure can be manufactured at a fairly low cost.

In the above description, the common electrode 19 is disposed on the bottom surface of the channels 12. However, the common electrode 19 may be supported on the cover film 15 similarly to the first and second embodiments.

The liquid ejection device 100 according to each of the above-described embodiments can be easily used as an ink jet print head. In this case, ink is used as liquid filling the channels 12. Ink is supplied Into the channels 12 from their rear end openings **12*b*. The ejection openings 12*a* of the channels 12 are processed into nozzle shapes. Ink will be ejected through the nozzles 12*a* from the channels 12. By applying the liquid ejection device 100 to an ink jet head in this manner, a high density compact ink jet head with 2,400 or more channels per inch (2,400 dpi) can be easily produced by setting the channel distribution pitch to 10 $\mu$m for example. The thus produced ink jet head can be easily controlled to perform an area gradation control and the like. According to the processes of each of the embodiments. It is possible to easily produce, in excellent yields, the compact ink ejection device that has a complicated configuration wherein the cover film 15 is formed uniformly over the upper edges of the plurality of partition walls 11** and that is driven with a low drive voltage to generate a sufficient displacement amount to apply pressure to ink in the channels.

The liquid ejection device 100 of each of the above-described embodiments can be employed also in the micromachining field as a device for supplying small amounts of liquid, that is, for example, as a pipette for supplying microdroplets.

While the invention has been described in detail with reference to the specific embodiments thereof, it would be apparent to those skilled in the art that various changes and modifications may be made therein without departing from is the spirit of the invention.

For example, in the above-described embodiments, the cover providing portion 1200 forms the cover film 15 through first filling the filler material 13 into the channels 12 and then depositing the cover film 15 over the top surface of the filler material 13 and the upper edges of the partition walls 11 However, the cover providing portion 1200 can employ other various methods for forming the cover film 15 over the upper edges of the partition walls 11. For example, the cover providing portion 1200 may prepare a supplementary substrate made of resin, oxide, or the like. The cover providing portion 1200 deposits a thin film on top of the supplementary substrate using a deposition process Then, the thin film-formed surface of the supplementary plate is adhered to the upper edges of the partition walls 11. Afterward, the supplementary substrate is removed to retain the thin film only on the partition walls 11. It is noted that the supplementary substrate can be attached to the upper edges of the partition walls 11 through an anodic bonding process or using atomic forces.

In the above-described embodiments, the cover providing portion 1200 forms the cover film 15 through a deposition and structure fabrication process. However, any other methods that enables forming the cover film 15 to a thickness of 5 $\mu$m or less are acceptable. For example, the cover providing portion 1200 can form the cover film 15 integrally to the entire liquid ejection device 1 through etching processes and the like.

The above description is referred to the drawings where the substrate 1 Is formed with only several channels 12. However, many more channels 12 can be formed in the single substrate 1. For example. the liquid ejection device 100 can be produced with several hundreds to several thousands of channels 12 aligned in parallel. By reducing the pitch at which the channels 12 are aligned, the channels 12 can be distributed at a high density. By arranging the channels 12 at a small pitch of 40 $\mu$m or less, the liquid ejection device can be produced wherein a few hundreds to a few thousands channels 12 are aligned per inch.

In the above-described embodiments, the cover film 15 is provided over all of the channels 12 formed in the substrate 1. However, the cover film 15 may be provided over at least one of the channels 12 in the substrate 1.

In the above-described embodiments, the single common electrode 19 Is provided to be shared by all the Individual electrodes 17 that are provided to the liquid ejection device 100. However, the common electrode 19 may not be provided for all the individual electrodes 17. A separate electrode 19 can be provided in confrontation with each individual electrode 17. Alternatively, an electrode 19 can be provided in confrontation with a group of several individual electrodes 17 so that each electrode 19 can be shared by several electrodes 17 in the corresponding group.

In the above-described embodiments, the ejection opening 12*a* is provided at the front end of each channel 12. However, the ejection opening may be formed in each channel 12 at any portion on all the six surfaces that define the subject channel 12 as long as the ejection opening can eject liquid outside.

In the above-described embodiments, the mechanism 16, 17, 18, and 19 operates to electrostatically deforms the cover film 15, thereby applying pressure to liquid filling the channels 12. However, other various methods can be employed to deform the cover film 15. For example, piezoelectric element-employed mechanism can be employed to deform the cover film 15 to apply pressure to liquid filling the channels 12.

In the embodiments, a resist that hardens at the predetermined fixed temperature is used as the filler material 13 to be introduced into the groove-shaped channels 12. However, other material, such as melted wax, can be used instead as the filler material 13. When wax is used, the wax will harden in the channels 12 when the wax cools. After the cover film 15 is formed, the filler material 13 can be removed by heating and evaporating the wax, rather than by using a solvent. The filler material 13 can be any material that can be removed. For example, wax or any other variety of oxides can be used as the filler material 13 instead of the resist.

What is claimed is:

1. A liquid ejection device comprising:

a substrate formed with a plurality of partition walls for defining a plurality of channels, each partition wall having an upper edge, each channel having a groove shape with an inner surface including a bottom surface, each two adjacent channels being separated from each other by a corresponding partition wall, each channel having, at at least one end thereof, a liquid ejection aperture for ejecting liquid filling the channel;

a cover film, having a thickness of 5 $\mu$m or less, that is deposited over the upper edge of at least one of the plurality of partition walls, the cover film covering at least one of the plurality of channels; and a pressure applying structure that selectively deforms the cover film to apply pressure to liquid filling a desired channel, thereby ejecting liquid from the desired channel through its ejection aperture.

2. A liquid ejection device as claimed in claim 1, wherein the cover film is made of silicon.

3. A liquid ejection device as claimed in claim 1, wherein the cover film has a thickness in a range of 0.1 $\mu$m and 5 $\mu$m.

4. A liquid ejection device as claimed in claim 3, wherein the cover film has a thickness in a range of 0.1 $\mu$m to 2.0 $\mu$m.

5. A liquid ejection device as claimed in claim 1, wherein the plurality of channels are aligned at a pitch of 40 $\mu$m or less.

6. A liquid ejection device as claimed in claim 1, wherein the pressure applying structure includes:

a drive electrode provided over the cover film; and a counter electrode provided in confrontation with the drive electrode, a gap being formed between the drive electrode and the counter electrode, a drive voltage being applied between the drive electrode and the counter electrode, thereby deforming the cover film by an electrostatic force.

7. A liquid ejection device as claimed in claim 6, wherein the drive electrode includes a plurality of individual electrodes that are provided on the cover film at areas corresponding to the plurality of channels, respectively, and that are electrically insulated from one another, wherein the counter electrode includes a single common electrode that is provided for the plurality of channels, in confrontation with the respective individual electrode, and wherein the pressure applying structure further includes a drive voltage applying portion that applies a first electric voltage to the common electrode and that selectively applies a second electric voltage to a desired individual electrode, thereby enabling a corresponding portion of the cover film to deform by an electrostatic force.

8. A liquid ejection device as claimed in claim 6, wherein the drive voltage is less than or equal to 50 volts.

9. A liquid ejection device as claimed in claim 6, further comprising a support member, provided to the cover film, supporting the counter electrode in confrontation with the drive electrode.

10. A liquid ejection device as claimed in claim 6, wherein the counter electrode is provided over the bottom surface of each channel.

11. A liquid ejection device as claimed in claim 6, the cover film has a flat shape in cross section at an area between each two adjacent partition walls, the flat shape extending flatly between the upper edges of the two adjacent partition walls.

12. A liquid ejection device as claimed in claim 6, the cover film has a convex shape in cross section at an area between each two adjacent partition walls, the convex shape extending between the upper edges of the two adjacent partition walls and protruding outwardly in a direction away from the bottom surface of the corresponding channel.

13. A liquid ejection device as claimed in claim 6, the cover film has a concave shape in cross section at an area between each two adjacent partition walls, the concave shape extending between the upper edges of the two adjacent partition walls and protruding inwardly in a direction toward the bottom surface of the corresponding channel.

14. A liquid ejection device as claimed in claim 1, wherein the cover film is produced through first filling a filler material into the entire portion of the plurality of channels to the height of the partition walls, then depositing the cover film over the upper edges of the partition walls and the upper surface of the filler material, and then removing the filler material from the plurality of channels.

15. A liquid ejection device, comprising a substrate formed with a plurality of partition walls for defining a plurality of channels, each partition wall having an upper edge, each channel having a groove shape with a bottom surface, each two adjacent channels being separated from each other by a corresponding partition wall, each channel having, at at least one end thereof, a liquid ejection aperture for ejecting liquid filling the channel;

a cover film, deposited over the upper edge of at least one of the plurality of partition walls, covering at least one of the plurality of channels; and a pressure applying structure that selectively deforms the cover film to apply pressure to liquid filling a desired channel, thereby ejecting liquid from the desired channel through its ejection aperture.

16. A liquid ejection device as claimed in claim 15, the cover film has a flat shape in cross section at an area between each two adjacent partition walls, the flat shape extending flatly between the upper edges of the two adjacent partition walls.

17. A liquid ejection device as claimed in claim 15, the cover film has a convex shape in cross section at an area between each two adjacent partition walls, the convex shape extending between the upper edges of the two adjacent partition walls and protruding outwardly in a direction away from the bottom surface of the corresponding channel.

18. A liquid ejection device as claimed in claim 15, the cover film has a concave shape in cross section at an area between each two adjacent partition walls, the concave shape extending between the upper edges of the two adjacent partition walls and protruding inwardly in a direction toward the bottom surface of the corresponding channel.

19. A liquid ejection device as claimed in claim 15, wherein the cover film is produced through first filling a filler material into the entire portion of the plurality of channels to the height of the partition walls, then depositing the cover film over the upper edges of the partition walls and the upper surface of the filler material, and then removing the filler material from the plurality of channels.

20. A liquid ejection device as claimed in claim 15, wherein the substrate is processed to be formed with the plurality of partition walls defining the plurality of channels, each partition wall having the upper edge, each channel having a groove shape with the bottom surface, each two adjacent channels being separated from each other by the corresponding partition wall, each channel having, at at least one end thereof, the liquid ejection aperture for ejecting liquid filling the channel, wherein the cover film is deposited over the upper edge of the at least one of the plurality of partition walls to cover the at least one of the plurality of channels, and wherein the pressure applying structure is provided to selectively deform the cover film to apply pressure to liquid filling a desired channel, thereby ejecting liquid from the desired channel through its ejection aperture.

21. A liquid ejection device as claimed in claim 20, wherein the cover film is deposited through introducing filler material into the plurality of channels up to the upper edges of the partition walls, depositing the cover film on the upper surface of the filler material and the upper edges of the plurality of partition walls, and removing the filler material from the channels after the cover film is deposited.

22. A liquid ejection device as claimed in claim 15, wherein the pressure applying structure includes:

a drive electrode provided over the cover film; and a counter electrode provided in confrontation with the drive electrode, a gap being formed between the drive electrode and the counter electrode, a drive voltage being applied between the drive electrode and the counter electrode, thereby deforming the cover film by an electrostatic force.

23. A liquid ejection device as claimed in claim 22, further comprising a support member, provided to the cover film, supporting the counter electrode in confrontation with the drive electrode.

24. A liquid ejection device as claimed in claim 22, wherein the counter electrode is provided over the bottom surface of each channel.

25. A liquid ejection device comprising:

a substrate formed with a plurality of partition walls for defining a plurality of channels, each partition wall having an upper edge, each channel having a groove shape with an inner surface including a bottom surface, each two adjacent channels being separated from each other by a corresponding partition wall, each channel having, at at least one end thereof, a liquid ejection aperture for ejecting liquid filling the channel;

a cover film provided over the upper edge of at least one of the plurality of partition walls, the cover film covering at least one of the plurality of channels; and a pressure applying structure that selectively deforms the cover film to apply pressure to liquid filling a desired channel, thereby ejecting liquid from the desired channel through its ejection aperture, wherein the pressure applying structure includes:

a drive electrode provided over the cover film; and a counter electrode provided in confrontation with the drive electrode, a drive voltage being applied between the drive electrode and the counter electrode, thereby deforming the cover film by an electrostatic force, further comprising a support member, provided to the cover film, supporting the counter electrode in confrontation with the drive electrode.

26. A liquid ejection device as claimed in claim 25, wherein the cover film has a thickness of 5 $\mu$m or less.

27. A liquid ejection device comprising:

a substrate formed with a plurality of partition walls for defining a plurality of channels, each partition wall having an upper edge, each channel having a groove shape with an inner surface including a bottom surface, each two adjacent channels being separated from each other by a corresponding partition wall, each channel having, at at least one end thereof, a liquid ejection aperture for ejecting liquid filling the channel;

a cover film provided over the upper edge of at least one of the plurality of partition walls, the cover film covering at least one of the plurality of channels; and a pressure applying structure that selectively deforms the cover film to apply pressure to liquid filling a desired channel, thereby ejecting liquid from the desired channel through its ejection aperture, wherein the pressure applying structure includes:

a drive electrode provided over the cover film; and a counter electrode provided in confrontation with the drive electrode, a drive voltage being applied between the drive electrode and the counter electrode, thereby deforming the cover film by an electrostatic force, wherein the counter electrode is provided over the bottom surface of each channel.

28. A liquid ejection device as claimed in claim 27, wherein the cover film has a thickness of 5 $\mu$m or less.

29. A liquid ejection device comprising:

a substrate formed with a plurality of partition walls for defining a plurality of channels, each partition wall having an upper edge, each channel having a groove shape with an inner surface including a bottom surface, each two adjacent channels being separated from each other by a corresponding partition wall, each channel having, at at least one end thereof, a liquid ejection aperture for ejecting liquid filling the channel;

a cover film provided over the upper edge of at least one of the plurality of partition walls, the cover film covering at least one of the plurality of channels; and a pressure applying structure that selectively deforms the cover film to apply pressure to liquid filling a desired channel, thereby ejecting liquid from the desired channel through its ejection aperture, wherein the cover film is produced through first filling a filler material into the entire portion of the plurality of channels to the height of the partition walls, then depositing the cover film over the upper edges of the partition walls and the upper surface of the filler material, and then removing the filler material from the plurality of channels.

30. A liquid ejection device as claimed in claim 29, wherein the cover film has a thickness of 5 $\mu$m or less.

31. A liquid ejection device comprising:

a substrate formed with a plurality of partition walls for defining a plurality of channels, each partition having an upper edge, each channel having a groove shape with an inner surface including a bottom surface, each two adjacent channels being separated from each other by a corresponding partition wall, each channel having, at at least one end thereof, a liquid ejection aperture for ejecting liquid filling the channel;

a cover film with a thickness of 5 $\mu$m or less being driven by an electrostatic force, the cover film being provided over the upper edges of at least two adjacent partition walls to thereby cover at least two adjacent channels; and a pressure applying structure that selectively drives the cover film by an electrostatic force to selectively deform the cover film to apply pressure to liquid filling a desired channel, thereby ejecting liquid from the desired channel through its ejection aperture.

32. A liquid ejection device comprising:

a substrate formed with a plurality of partition walls for defining a plurality of channels, each partition having an upper edge, each channel having a groove shape with an inner surface including a bottom surface, each two adjacent channels being separated from each other by a corresponding partition wall, each channel having, at at least one end thereof, a liquid ejection aperture for ejecting liquid filling the channel;

a cover film being driven by an electrostatic force, the cover film being provided over the upper edges of at least two adjacent partition walls to thereby cover at least two adjacent channels; and a pressure applying structure that selectively drives the cover film by an electrostatic force to selectively deform the cover film to apply pressure to liquid filling a desired channel, thereby ejecting liquid from the desired channel through its ejection aperture, wherein the pressure applying structure includes at least two drive electrodes provided over the cover film at positions in one-to-one correspondence with the at least two adjacent channels; and a counter electrode provided in confrontation with the drive electrodes, the gap being formed between the drive electrodes and the counter electrode, a drive voltage being selectively applied between the drive electrodes and the counter electrode, thereby selectively deforming the cover film by an electrostatic force, further comprising at least two support members provided to the cover film at locations in one-to-to-one correspondence with the at least two adjacent partition walls supporting the counter electrode in confrontation with the at least two drive electrodes.

33. A liquid ejection device, comprising:

a substrate formed with a plurality of partition walls for defining a plurality of channels, each partition wall having an upper edge, each channel having a groove shape with a bottom surface, each two adjacent channels being separated from each other by a corresponding partition wall, each channel having, at at least one end thereof, a liquid ejection apparatus for ejecting liquid filling the channel;

a cover film for being driven by an electrostatic force, the cover film being deposited over the upper edges of at least two adjacent partition walls to thereby cover at least two adjacent channels; and a pressure applying structure that selectively drives the cover film by an electrostatic force to selectively deform the cover film to apply pressure to liquid filling a desired channel, thereby ejecting liquid from the desired channel through its ejection aperture.

34. A liquid ejection device as claimed in claim 33, wherein the pressure applying structure includes:

at least two drive electrodes provided over the cover film at positions in one to one correspondence with the at least two adjacent channels; and a counter electrode provided in confrontation with the drive electrodes, a gap being formed between the drive electrodes and the counter electrode, a drive voltage being selectively applied between the drive electrodes and the counter electrode, thereby selectively deforming the cover film by an electrostatic force, further comprising at least two support members, provided to the cover film at locations in one to one correspondence with the at least two adjacent partition walls, supporting the counter electrode in confrontation with the at least two drive electrodes.

35. A liquid ejection device, comprising:

a substrate having two or more partition walls, the two or more partition walls being located adjacent to each other and defining two or more adjacent channels, each partition wall having an upper edge, each channel having a groove shape with an inner surface including a bottom surface, the two or more adjacent channels being separated from each other by the partition walls, each channel having, at at least one end thereof, a liquid ejection aperture for ejecting liquid filling the channel;

a cover film for being driven by an electrostatic force, the cover film being provided over the upper edges of the two or more adjacent partition walls to thereby cover the two or more adjacent channels; and a pressure applying structure that selectively drives the cover film by an electrostatic force to selectively deform the cover film to apply pressure to liquid filling a desired channel, thereby ejecting liquid from the desired channel through its ejection aperture.

36. A liquid ejection device as claimed in claim 35, wherein the cover film is deposited into a thickness of 5 $\mu$m or less.

37. A liquid ejection device as claimed in claim 35, wherein the pressure applying structure includes:

two or more drive electrodes provided over the cover film at positions in one to one correspondence with the two or more adjacent channels; and a counter electrode provided in confrontation with the drive electrodes, a gap being formed between the drive electrodes and the counter electrode, a drive voltage being selectively applied between the drive electrodes and the counter electrode, thereby selectively deforming the cover film by an electrostatic force.

* * * * *